US012569103B2

(12) United States Patent
Lee et al.

(10) Patent No.: US 12,569,103 B2
(45) Date of Patent: Mar. 10, 2026

(54) WET ROBOT CLEANER AND CONTAMINATION PREVENTION MODULE USED THEREFOR

(71) Applicant: SAMSUNG ELECTRONICS CO., LTD., Suwon-si (KR)

(72) Inventors: Hakbong Lee, Suwon-si (KR); Junggyun Han, Suwon-si (KR); Eugene Chung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 370 days.

(21) Appl. No.: 18/196,572

(22) Filed: May 12, 2023

(65) Prior Publication Data

US 2023/0404350 A1 Dec. 21, 2023

Related U.S. Application Data

(63) Continuation of application No. PCT/KR2023/005613, filed on Apr. 25, 2023.

(30) Foreign Application Priority Data

Jun. 13, 2022 (KR) ..... 10-2022-0071728

(51) Int. Cl.
*A47L 11/40* (2006.01)
*A47L 11/282* (2006.01)

(52) U.S. Cl.
CPC ..... *A47L 11/4044* (2013.01); *A47L 11/282* (2013.01); *A47L 11/4038* (2013.01);
(Continued)

(58) Field of Classification Search
CPC .... A47L 11/40; A47L 11/282; A47L 11/4044; A47L 11/4072
See application file for complete search history.

(56) References Cited

U.S. PATENT DOCUMENTS 3,888,256 A * 6/1975 Studinger ..... A61F 13/534 604/377
8,671,514 B2 3/2014 Iles
(Continued)

FOREIGN PATENT DOCUMENTS

CN 108742329 A 11/2018
EP 3 485 787 A1 5/2019
(Continued)

OTHER PUBLICATIONS

International Search Report dated Jul. 27, 2023 for International Application No. PCT/KR2023/005613.
(Continued)

*Primary Examiner* — Michael D Jennings
(74) *Attorney, Agent, or Firm* — STAAS & HALSEY LLP

(57) ABSTRACT

A wet cleaning robot includes a body configured to be movable on a surface to be cleaned; a rotational wet pad arranged on a bottom of the body and including a wettable surface configured to contact the surface to wet clean the surface; an electrostatic adsorption pad arranged in front of the rotational wet pad and configured to electrostatically adsorb a foreign substance on the surface under the electrostatic adsorption pad; and a foreign substance barrier wall arranged between the rotational wet pad and the electrostatic adsorption pad to prevent the foreign substance adsorbed on the electrostatic adsorption pad from moving to the rotational wet pad.

20 Claims, 19 Drawing Sheets

(52) U.S. Cl.
CPC ..... *A47L 11/4066* (2013.01); *A47L 11/4072* (2013.01); *A47L 2201/04* (2013.01)

(56) References Cited

U.S. PATENT DOCUMENTS

| | | | | |
|---|---|---|---|---|
| 8,806,710 | B2 | 8/2014 | Follows et al. | |
| 9,609,983 | B2 * | 4/2017 | McCarthy | D04B 21/02 |
| 10,219,672 | B2 * | 3/2019 | Calimano | B32B 3/26 |
| 10,993,598 | B2 | 5/2021 | Park et al. | |
| 11,622,661 | B2 | 4/2023 | Jang et al. | |
| 2016/0270618 | A1 * | 9/2016 | Lu | A47L 9/2805 |
| 2017/0164797 | A1 * | 6/2017 | Abramson | B62D 57/024 |
| 2018/0000306 | A1 | 1/2018 | Caruso | |
| 2019/0038101 | A1 * | 2/2019 | Jang | A47L 11/4002 |
| 2019/0038103 | A1 * | 2/2019 | Jang | A47L 11/24 |
| 2019/0038105 | A1 * | 2/2019 | Park | A47L 9/28 |
| 2019/0038106 | A1 * | 2/2019 | Jang | A47L 11/4005 |
| 2020/0139561 | A1 * | 5/2020 | Kim | B25J 11/0085 |
| 2020/0297179 | A1 | 9/2020 | Fang | |
| 2021/0030246 | A1 * | 2/2021 | Jang | A47L 11/4066 |
| 2021/0145237 | A1 * | 5/2021 | Yang | A47L 9/0686 |
| 2021/0169297 | A1 * | 6/2021 | Jang | A47L 11/4069 |
| 2021/0186293 | A1 * | 6/2021 | Jung | A47L 11/4011 |
| 2021/0259497 | A1 | 8/2021 | Park et al. | |
| 2021/0290026 | A1 * | 9/2021 | Shin | A47L 11/4038 |
| 2022/0061610 | A1 | 3/2022 | Espin Franco | |
| 2022/0071465 | A1 | 3/2022 | Kim et al. | |
| 2022/0349169 | A1 * | 11/2022 | Gannon | F16M 5/00 |
| 2022/0369889 | A1 | 11/2022 | Seo et al. | |
| 2022/0408997 | A1 | 12/2022 | Jung et al. | |

FOREIGN PATENT DOCUMENTS

| | | | |
|---|---|---|---|
| KR | 10-0504860 | B1 | 7/2005 |
| KR | 10-0697023 | B1 | 3/2007 |
| KR | 10-1138657 | | 4/2012 |
| KR | 10-1253639 | | 4/2013 |
| KR | 10-1333008 | | 12/2013 |
| KR | 10-1465713 | | 12/2014 |
| KR | 10-1475774 | | 12/2014 |
| KR | 10-1925965 | B1 | 2/2019 |
| KR | 10-2019-0085388 | A | 7/2019 |
| KR | 10-1994691 | B1 | 7/2019 |
| KR | 10-2021828 | B1 | 9/2019 |
| KR | 10-2021-0055444 | A | 5/2021 |
| KR | 10-2021-0081933 | A | 7/2021 |
| KR | 10-2278584 | B1 | 7/2021 |
| KR | 10-2317049 | | 10/2021 |
| KR | 10-2359206 | B1 | 2/2022 |

OTHER PUBLICATIONS

Extended European Search Report dated Apr. 24, 2025 for EP Patent Application No. 23824076.6.

* cited by examiner

WET ROBOT CLEANER AND CONTAMINATION PREVENTION MODULE USED THEREFOR

CROSS-REFERENCE TO RELATED APPLICATIONS

This application is a continuation application of international Application No. PCT/KR2023/005613, filed on Apr. 25, 2023, and claims priority to Korean Patent Application No. 10-2022-0071728, filed on Jun. 13, 2022, the disclosures of which are incorporated by reference herein in their entireties.

TECHNICAL FIELD

The disclosure provides a wet robot cleaner and a contamination prevention module used therefor.

BACKGROUND ART

A robot cleaner is a device that automatically cleans a surface to be cleaned while autonomously traveling in an area to be cleaned without a user's manipulation. The robot cleaner may include a dry-type robot cleaner that removes foreign substances from a surface to be cleaned through suction and a wet-type robot cleaner (hereinafter, referred to as a wet robot cleaner) that automatically wipes the surface to be cleaned with water.

The wet robot cleaner may include a wet pad for wet cleaning the surface to be cleaned, but may not include a suction structure for sucking up and removing foreign substances. The wet robot cleaner having no suction structure may have a main function of wet cleaning.

However, in the wet robot cleaner having no suction structure, the wet pad may be easily polluted by the foreign substances present on the surface to be cleaned. When the foreign substances stick to the wet pad, a time and an area in which wet cleaning of the wet robot cleaner is possible may be reduced. Moreover, additional contamination of the surface to be cleaned may occur due to the wet pad contaminated by the foreign substances.

DESCRIPTION OF EMBODIMENTS

Solution to Problem

According to an embodiment of the disclosure, a wet cleaning robot may include a body configured to be movable on a surface to be cleaned; a rotational wet pad arranged on a bottom of the body and including a wettable surface configured to contact the surface to wet clean the surface.

The wet cleaning robot according to an embodiment of the disclosure may include an electrostatic adsorption pad arranged in front of the rotational wet pad and configured to electrostatically adsorb a foreign substance on the surface under the electrostatic adsorption pad; and a foreign substance barrier wall arranged between the rotational wet pad and the electrostatic adsorption pad to prevent the foreign substance adsorbed on the electrostatic adsorption pad from moving to the rotational wet pad.

According to an embodiment of the disclosure, the electrostatic adsorption pad is configured to be separated from the surface in an up-down direction such that the foreign substance on the surface overlaps the electrostatic adsorption pad and is adsorbed on the electrostatic adsorption pad.

According to an embodiment of the disclosure, a width of the electrostatic adsorption pad in a left-right direction is equal to or greater than a width of the rotational wet pad in the left-right direction.

According to an embodiment of the disclosure, the wet cleaning robot further includes a coupling body detachably mounted on the body, wherein the electrostatic adsorption pad is arranged on a bottom of the coupling body.

According to an embodiment of the disclosure, the electrostatic adsorption pad is configured to be detachably attached to the bottom of the coupling body.

According to an embodiment of the disclosure, the coupling body includes a structure configured to be slidably coupled to the body in an up-down direction.

According to an embodiment of the disclosure, a gap between the surface and the foreign substance barrier wall in an up-down direction is less than a gap between the surface and the electrostatic adsorption pad in the up-down direction.

According to an embodiment of the disclosure, the foreign substance barrier wall has a brush shape to trap the foreign substance therein.

According to an embodiment of the disclosure, a width of the foreign substance barrier wall in a left-right direction is equal to or greater than a width of the rotational wet pad in the left-right direction.

According to an embodiment of the disclosure, a length of the foreign substance barrier wall in a front-rear direction is less than a length of the electrostatic adsorption pad in the front-rear direction.

According to an embodiment of the disclosure, a pair of driving wheels are installed in the body, and the rotational wet pad is arranged in front of the pair of driving wheels.

According to an embodiment of the disclosure, a contamination prevention module to prevent a wet cleaning module from being contaminated by a foreign substance, the wet cleaning module including a body that is movable on a surface to be cleaned and a rotational wet pad on a bottom of the body with a wettable surface to wet clean the surface, may include a coupling body configured to be detachably coupled to the body of the wet cleaning module; an electrostatic adsorption pad arranged on a bottom of the coupling body; and a foreign substance barrier wall arranged on a bottom of the coupling body.

While the coupling body is coupled to the body of the wet cleaning module, the electrostatic adsorption pad is located in front of the rotational wet pad and configured to electrostatically adsorb a foreign substance on the surface under the electrostatic adsorption pad, and the foreign substance barrier is arranged between the rotational wet pad and the electrostatic adsorption pad to prevent the foreign substance adsorbed on the electrostatic adsorption pad from moving to the rotational wet pad.

According to an embodiment of the disclosure, the electrostatic adsorption pad is configured to be separated from the surface in an up-down direction such that the foreign substance on the cleaning surface overlaps the electrostatic adsorption pad and is adsorbed on the electrostatic adsorption pad.

According to an embodiment of the disclosure, a width of the electrostatic adsorption pad in a left-right direction is equal to or greater than a width of the rotational wet pad in the left-right direction.

According to an embodiment of the disclosure, the electrostatic adsorption pad is configured to be detachably attached to the bottom of the coupling body.

According to an embodiment of the disclosure, the coupling body includes a structure configured to be slidably coupled to the body in an up-down direction.

According to an embodiment of the disclosure, a gap between the surface and the foreign substance barrier wall in an up-down direction is less than a gap between the surface and the electrostatic adsorption pad in the up-down direction.

According to an embodiment of the disclosure, the foreign substance barrier wall has a brush shape to trap the foreign substance therein.

According to an embodiment of the disclosure, a width of the foreign substance barrier wall in a left-right direction is equal to or greater than a width of the rotational wet pad in the left-right direction.

According to an embodiment of the disclosure, a length of the foreign substance barrier wall in a front-rear direction is less than a length of the rotational wet pad in the front-rear direction.

MODE OF DISCLOSURE

Figure 1:
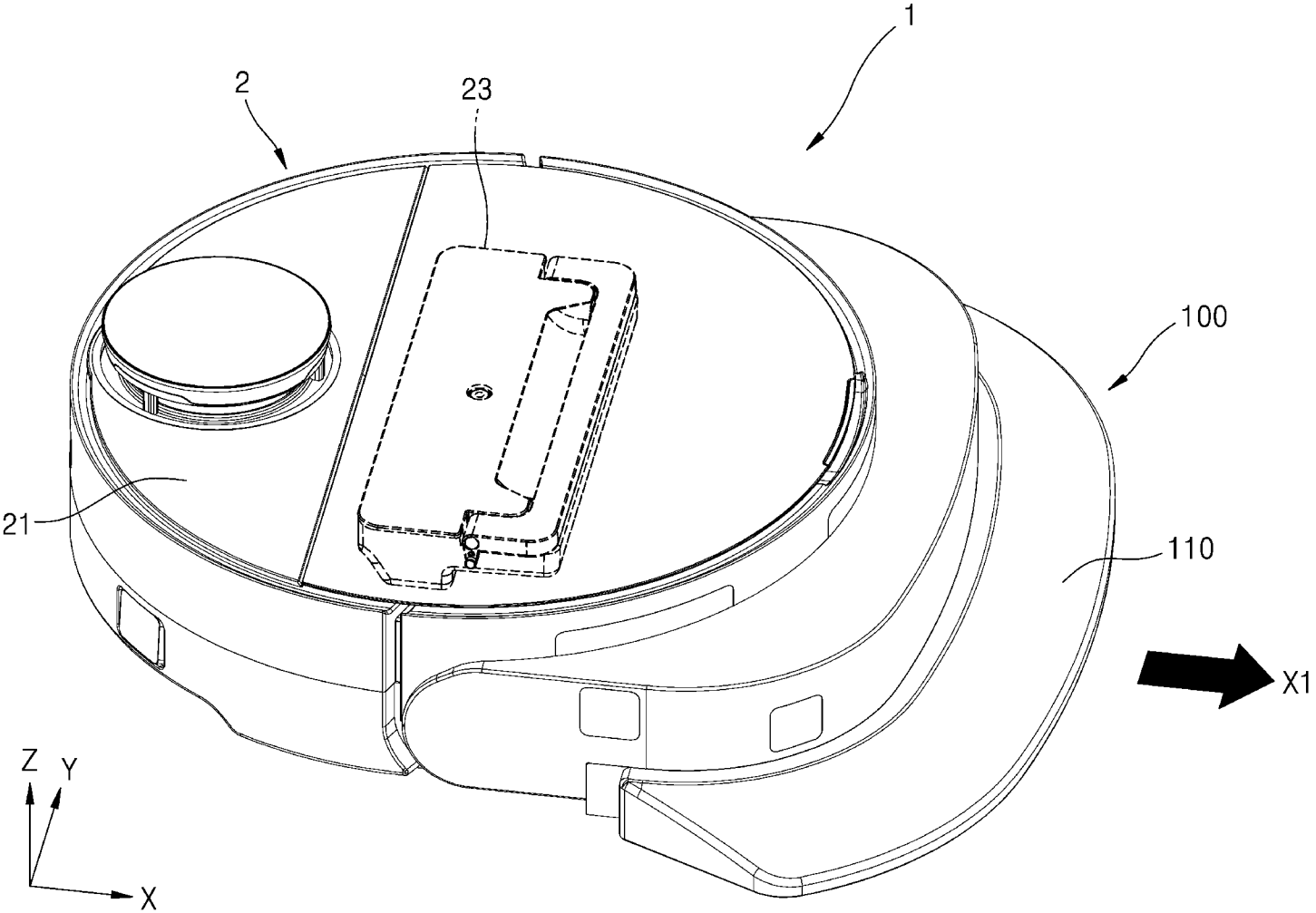
FIG. 1 is a perspective view of a wet robot cleaner according to an embodiment of the disclosure.

Throughout the disclosure, the expression "at least one of a, b or c" indicates only a, only b, only c, both a and b, both a and c, both b and c, all of a, b, and c, or variations thereof.

Hereinafter, an example embodiment of the disclosure will be described in detail with reference to matters described in the accompanying drawings. The same reference numeral or symbol presented in each drawing represents a part or component that performs substantially the same function.

The terms including "first", "second", etc., may be used to explain various components, but the components are not limited by the terms. These terms may be used to distinguish one element from another element. For example, a first component may be referred to as a second component without departing from the scope of the disclosure, and similarly, the second component may be referred to as the first component. The term "and/or" may include a combination of a plurality of related items or any one of the plurality of related items.

The term used herein is used to describe an embodiment of the disclosure, and is not intended to limit and/or restrict the disclosure. Singular forms include plural forms unless apparently indicated otherwise contextually. Moreover, it should be understood that the term "include", "have", or the like used herein is to indicate the presence of features, numbers, steps, operations, elements, parts, or a combination thereof described in the specifications, and does not preclude the presence or addition of one or more other features, numbers, steps, operations, elements, parts, or a combination thereof. The same reference numeral presented in each drawing represents a member that substantially performs the same function.

Figure 2:
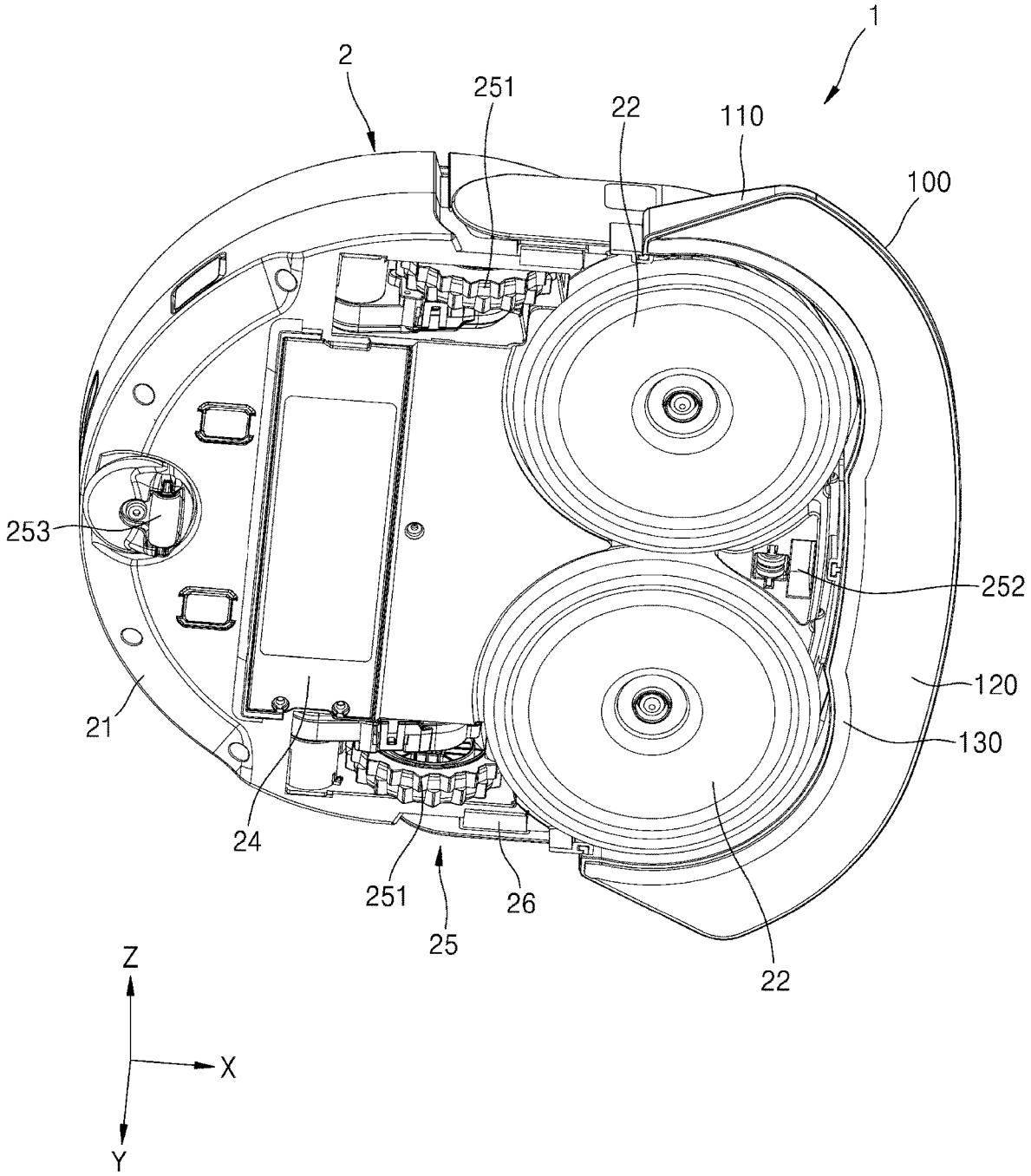
FIG. 2 is a perspective view of the wet robot cleaner of FIG. 1, viewed from below, according to an embodiment of the disclosure.
Figure 3:
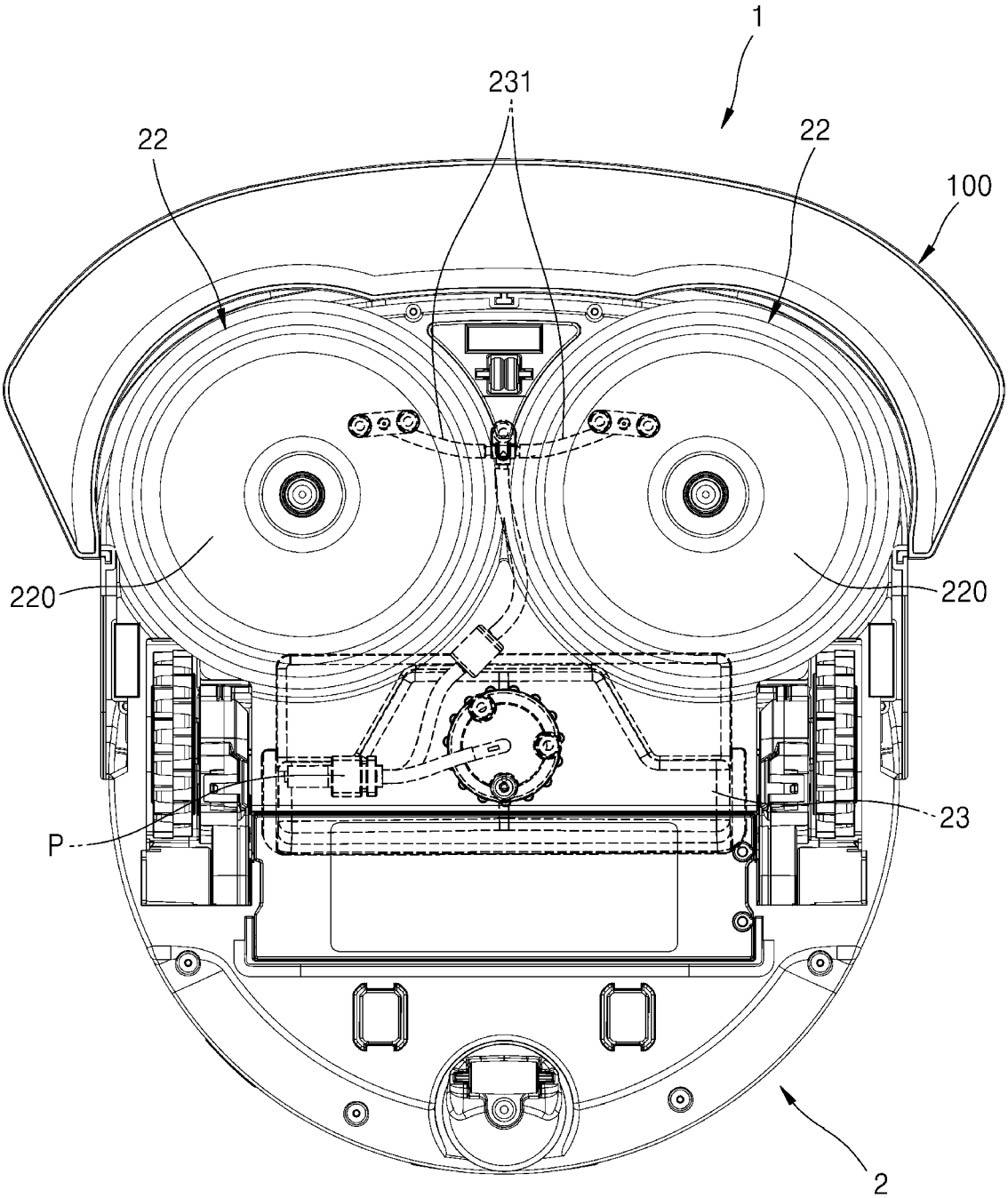
FIG. 3 is a view for describing wet cleaning with a rotational wet pad in the wet robot cleaner of FIG. 1 according to an embodiment of the disclosure.
Figure 4:
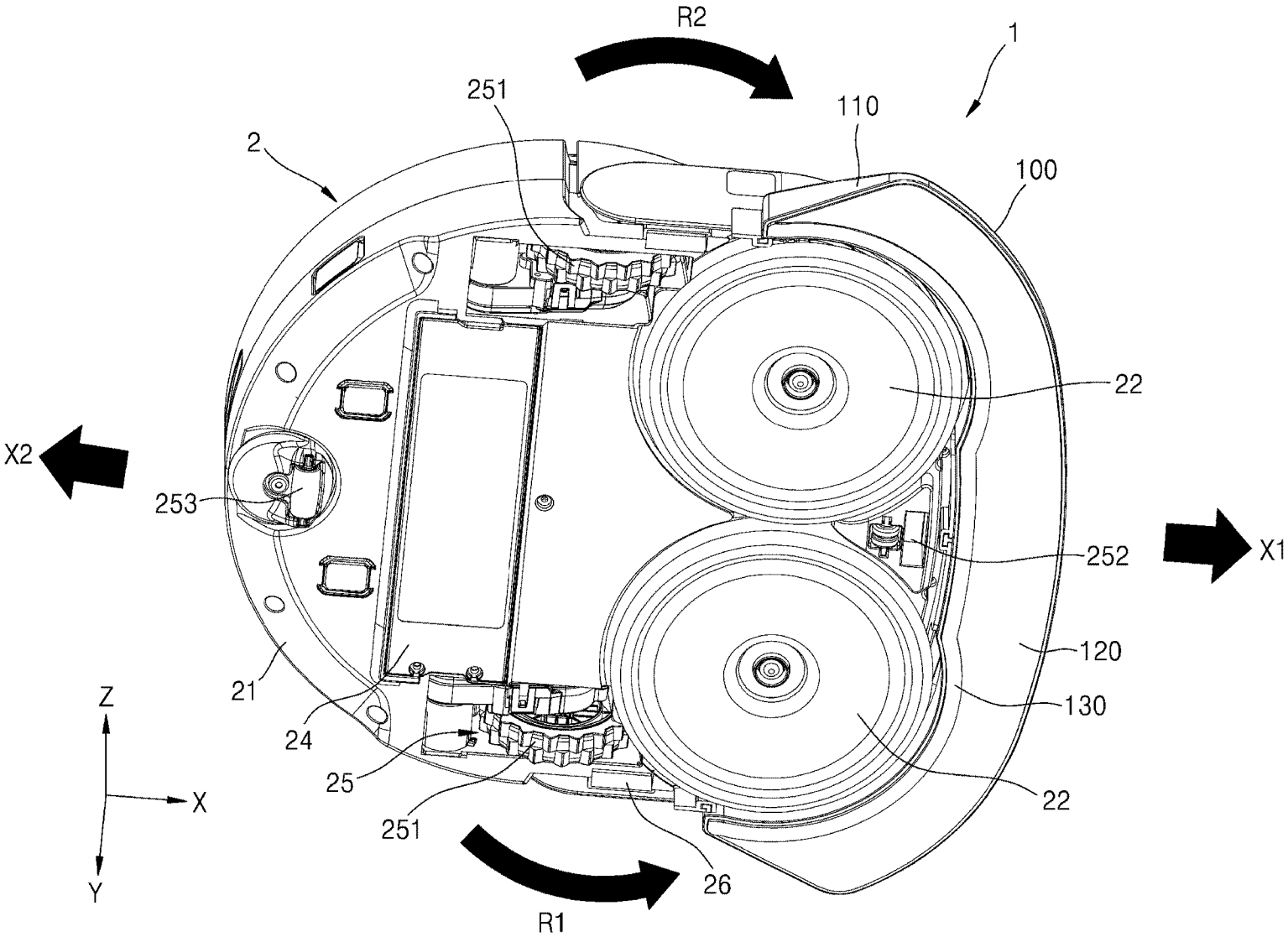
FIG. 4 is a view for describing an operation of the wet robot cleaner of FIG. 1 according to an embodiment of the disclosure.

FIG. 1 is a perspective view of a wet cleaning robot 1 according to an embodiment of the disclosure, and FIG. 2 is a perspective view of the wet cleaning robot 1 of FIG. 1, viewed from below. FIG. 3 is a view for describing wet cleaning with a rotational wet pad 22 in the wet robot cleaner 1 of FIG. 1. FIG. 4 is a view for describing an operation of the wet robot cleaner 1 of FIG. 1.

Referring to FIGS. 1 to 3, the wet robot cleaner 1 according to an embodiment of the disclosure may include a wet cleaning module 2 and a contamination prevention module 100. The wet cleaning module 2 may include a body 21 and the rotational wet pad 22.

The rotational wet pad 22 may be arranged on a bottom of the body 21. The rotational wet pad 22 may be arranged rotatable on a bottom of the body 21. The rotational wet pad 22 may include a wet (or wettable) surface 220 contacting a surface CF to be cleaned to enable wet cleaning with respect to the surface CF. The rotational wet pad 22 may provide surface contact to the surface CF. The rotational wet pad 22 may be arranged in a front side of a driving wheel 251.

The rotational wet pad 22 may be plural. For example, the rotational wet pad 22 may be a pair of rotational wet pads 22 having the same size. However, the number and size of rotational wet pads 22 may not be limited thereto and may be various. For example, although not shown, the number of rotational wet pads 22 may be 1 or 3 or more. For example, although not shown, the size of a plurality of rotational wet pads 22 may have different sizes.

Referring to FIGS. 1 and 3, a water storage container 23 that stores water to be supplied to the rotational wet pad 22 may be arranged inside the body 21. The water stored in the water storage container 23 may be supplied to the rotational wet pad 22 through a connection hose 231. A pump P may be connected to the connection hose 231 to adjust a pressure of water supplied to the rotational wet pad 22. The water stored in the water storage container 23 may be supplied to the rotational wet pad 22 without being separately heated. When water is supplied to the rotational wet pad 22, a wet surface 220 may remain wet. However, a structure in which the water is supplied to the rotational wet pad 22 is not necessarily limited thereto, and various structures may be adopted.

Referring to FIG. 4, the body 21 may move with respect to the surface CF. For example, the body 21 may move and rotate in a front-rear direction X with respect to the surface CF. For example, the body 21 may move in a front direction X1 or in a rear direction X2. For example, the body 21 may rotate in a clockwise direction R1 or in a counterclockwise direction R2. For example, the body 21 may rotate in the clockwise direction R1 or in the counterclockwise direction R2 while moving in the front direction X1, or rotate in the clockwise direction R1 or in the counterclockwise direction R2 while moving in the rear direction X2.

For movement and rotation of the body 21, a moving unit 25 may be installed in the body 21. For example, the moving unit 25 may include a pair of driving wheels 251, a front roller 252, and a rear roller 253 that are arranged on the bottom of the body 21. The pair of driving wheels 251 may be arranged in the rear side of the pair of rotational wet pads 22. The front roller 252 may be arranged between the pair of rotational wet pads 22, and the rear roller 253 may be arranged in the rear side with respect to the pair of driving wheels 251.

The pair of driving wheels 251 may rotate with power, and may rotate in the same direction or in different directions. The front roller 252 and the rear roller 253 may rotate by contact with the surface CF, and rotation axes thereof may change with a moving direction of the body 21. In the current embodiment of the disclosure, a description has been described mainly of an example where a separate moving unit 25 is installed for movement and rotation of the body 21, but the disclosure is not necessarily limited thereto. For example, although not shown, movement and rotation of the body 21 may be possible with the plurality of rotational wet pads 22.

In the body 21, various components for an operation of the wet cleaning robot 1 may be arranged. For example, a sensor 26, a battery 24, a bumper (not shown), etc., may be arranged in the body 21. The sensor 26 may detect a fall of the wet robot cleaner 1, etc., and the battery 24 may store energy for the operation of the wet robot cleaner 1. The bumper may be arranged on an outer circumferential surface of the body 21, and absorb an impact during a collusion. The wet robot cleaner 1 may wirelessly operate by the battery 24. The wet robot cleaner 1 may be docked to a separate docking system (not shown) to charge the battery 24.

A planar shape of the body 21 may be circular. However, the planar shape of the body 21 may not be limited thereto and may be various. For example, although not shown, the planar shape of the body 21 may be a rectangle with rounded corners.

In the wet robot cleaner 1 structured as described above, as the rotational wet pad 22 rotates in a state of the wet surface 220 of the rotational wet pad 22 contacting the surface CF, wet cleaning may be performed with respect to the surface CF. As the body 21 moves in the front direction X1, the rotational wet pad 22 may move in the front direction X1 and wet cleaning may be performed with respect to the surface CF.

However, a main function of the wet robot cleaner 1 is wet cleaning, such that a component for removing a foreign substance D by suction may not be included in the wet robot cleaner 1. Thus, when the foreign substance D such as hair, pet hair, and a lump of dust, etc., exists on the surface CF, the rotational wet pad 22 of the wet robot cleaner 1 may be vulnerable to contamination by the foreign substance D. When the rotational wet pad 22 is contaminated by adsorption of the foreign substance D, a cleaning capability of the rotational wet pad 22 may be degraded.

The wet robot cleaner 1 according to an embodiment of the disclosure may include the contamination prevention module 100 to improve the cleaning capability of the rotational wet pad 22. The contamination prevention module 100 may include an electrostatic adsorption pad 120 and a foreign substance barrier wall 130.

Figure 5:
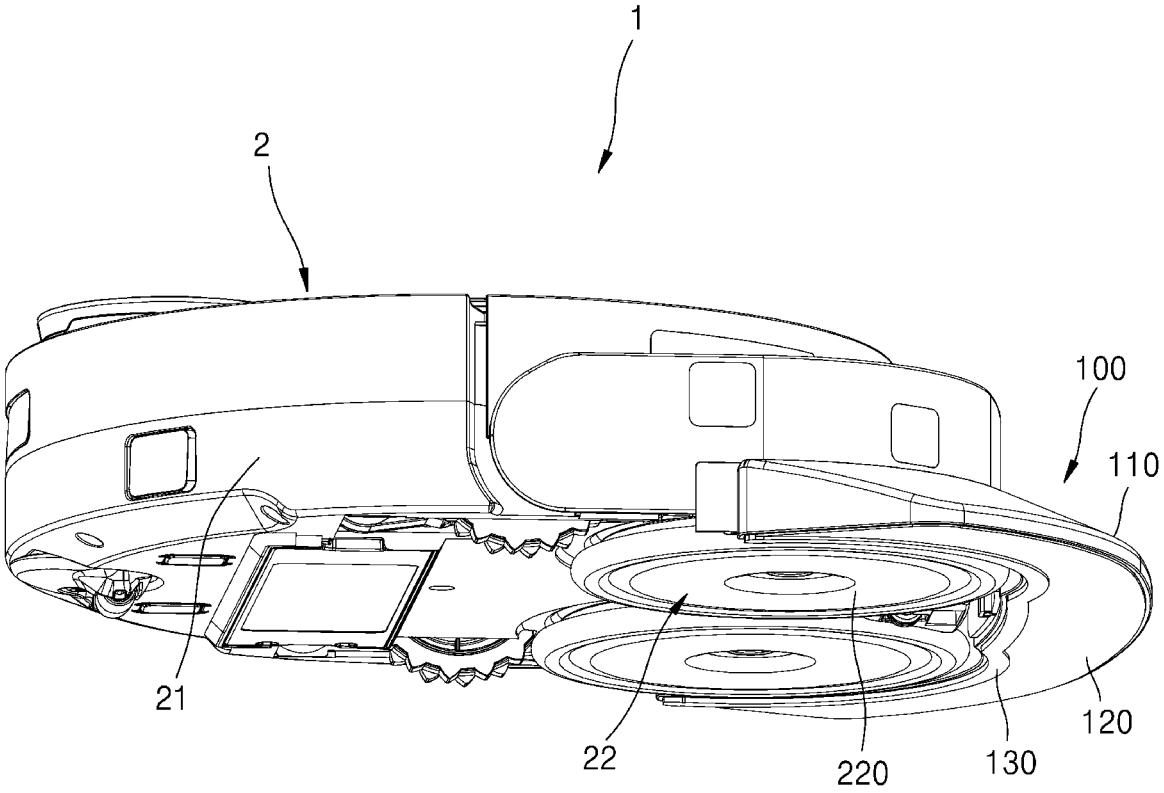
FIG. 5 is a perspective view of a wet robot cleaner including a contamination prevention module, viewed from below, according to an embodiment of the disclosure.
Figure 6:
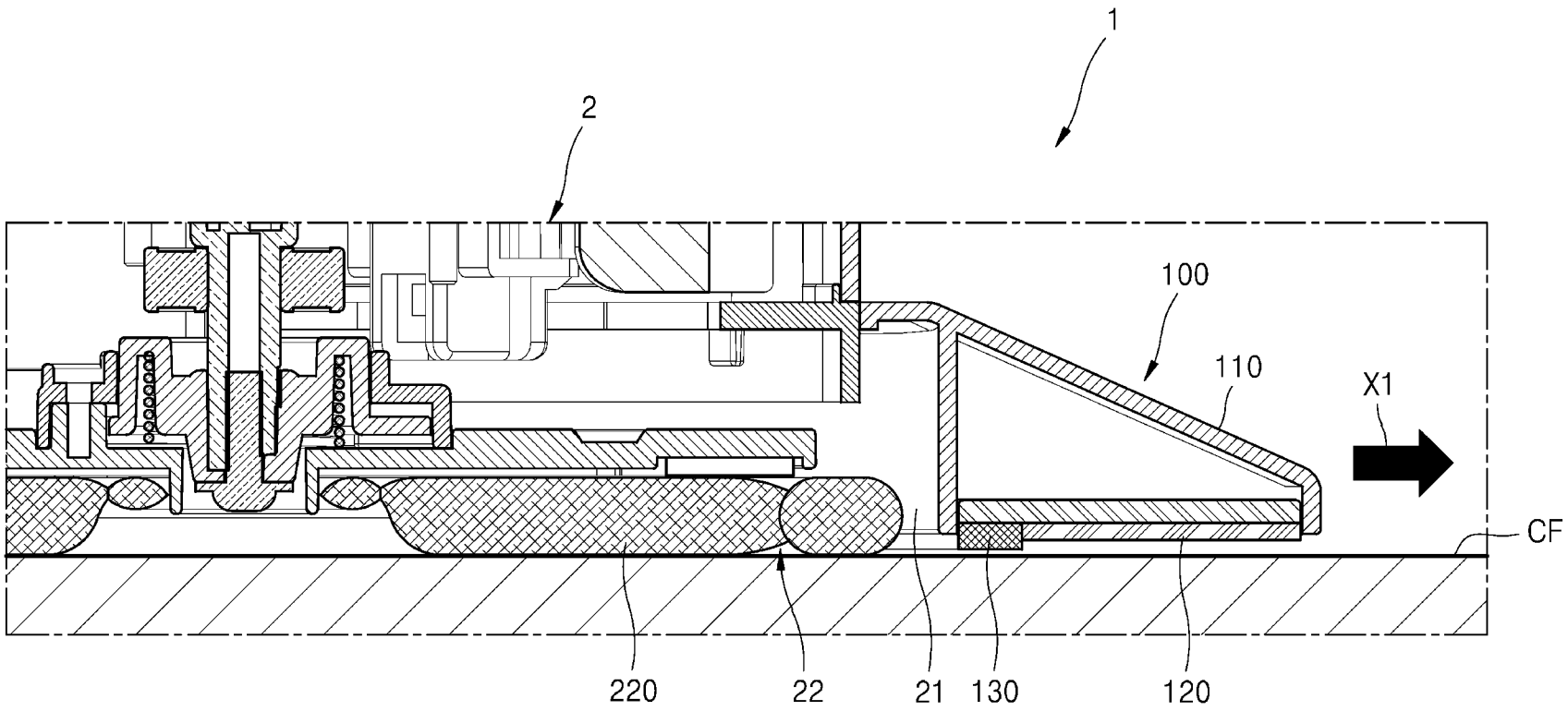
FIG. 6 is a cross-sectional view for describing the contamination prevention module of FIG. 5 according to an embodiment of the disclosure.
Figure 7:
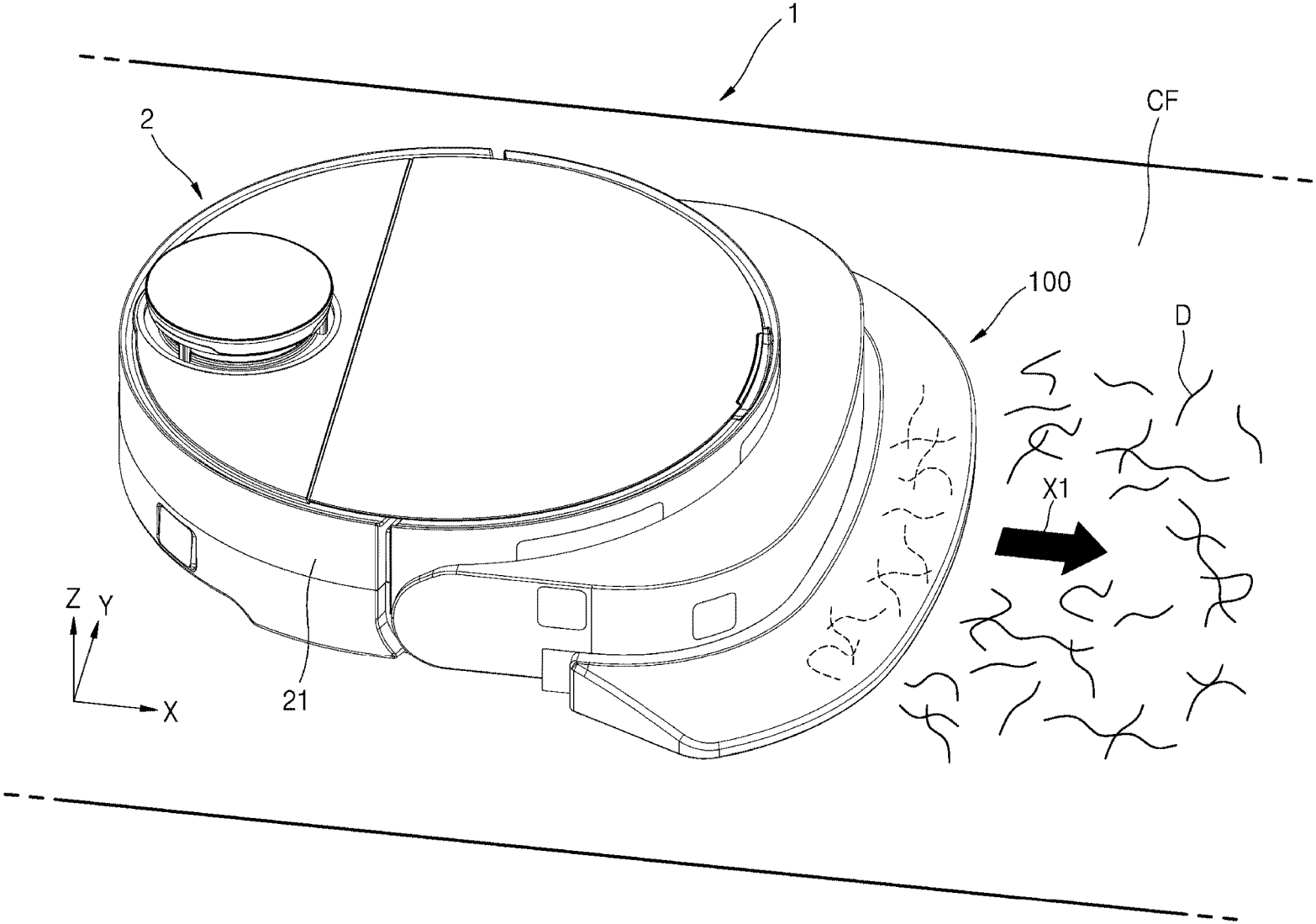
FIG. 7 is a perspective view showing that a foreign substance is adsorbed by the contamination prevention module of the wet robot cleaner of FIG. 5 according to an embodiment of the disclosure.

FIG. 5 is a perspective view of the wet robot cleaner 1 including the contamination prevention module 100, viewed from below, according to an embodiment of the disclosure, and FIG. 6 is a cross-sectional view for describing the contamination prevention module 100 of FIG. 5. FIG. 7 is a perspective view showing that the foreign substance D is adsorbed by the contamination prevention module 100 of the wet robot cleaner 1 of FIG. and FIG. 8 is a cross-sectional view showing that the foreign substance D is adsorbed by the contamination prevention module 100 of FIG. 7.

Referring to FIGS. 5 and 6, the contamination prevention module 100 may include the electrostatic adsorption pad 120 and the foreign substance barrier wall 130. The contamination prevention module 100 may further include a coupling body 110 that is separate from the body 21.

The electrostatic adsorption pad 120 may be arranged in the front side of the rotational wet pad 22. When the body 21 moves in the front direction X1, the electrostatic adsorption pad 120 may be arranged in front of the rotational wet pad 22. Thus, when the wet robot cleaner 1 moves in the front direction X1, the foreign substance D may be adsorbed by the electrostatic adsorption pad 120 before the foreign substance D on the surface CF can be adsorbed on the rotational wet pad 22.

Figure 8:
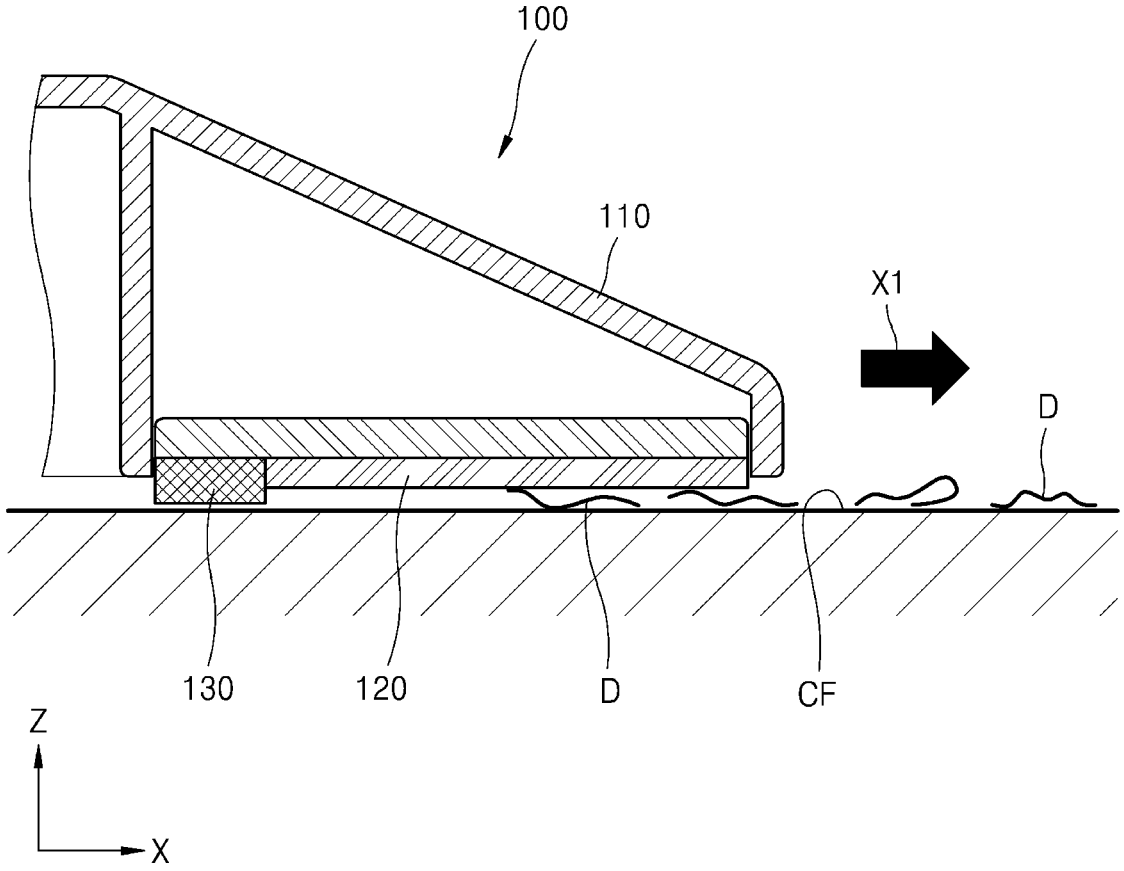
FIG. 8 is a cross-sectional view showing that a foreign substance is adsorbed by the contamination prevention module of FIG. 7 according to an embodiment of the disclosure.

Referring to FIGS. 7 and 8, the electrostatic adsorption pad 120 of the contamination prevention module 100 may adsorb the foreign substance D in an electrostatic manner. The electrostatic adsorption pad 120 of the contamination prevention module 100 may electrostatically adsorb the foreign substance D. The electrostatic adsorption pad 120 may include a material capable of providing an electrostatic force. For example, the material of the electrostatic adsorption pad 120 may include non-woven fabric. The electrostatic adsorption pad 120 has a pad form, thus providing a wider adsorption area than that of a drum form.

The electrostatic adsorption pad 120 may adsorb the foreign substance D by the electrostatic force without contacting the surface CF. The electrostatic adsorption pad 120 may be spaced from the surface CF in an up-down direction Z. Thus, as the body 21 moves in the front direction X1, the foreign substance D on the surface CF may overlap the electrostatic adsorption pad 120, thus being adsorbed to the electrostatic adsorption pad 120.

The electrostatic adsorption pad 120 may adsorb the foreign substance D by the electrostatic force, thus requiring no separate driving source. Therefore, a space or area for adsorption in the wet cleaning robot 1 may be designed to be small, thus being useful for wet cleaning with respect to a space having a narrow width and a low height.

Figure 9:
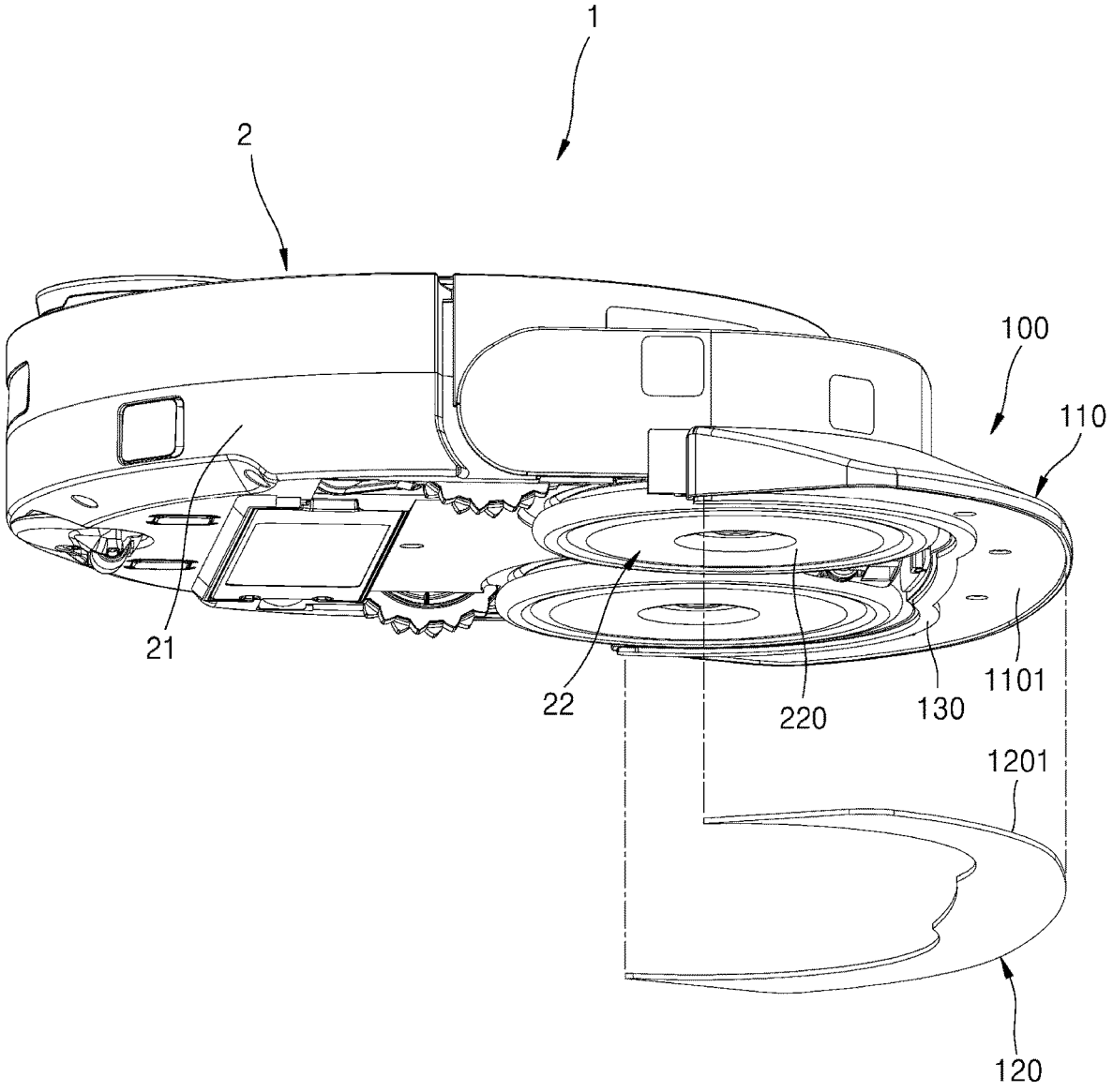
FIG. 9 is a view for describing an example of a state where an electrostatic adsorption pad is detached from the wet robot cleaner of FIG. 5 according to an embodiment of the disclosure.
Figure 10:
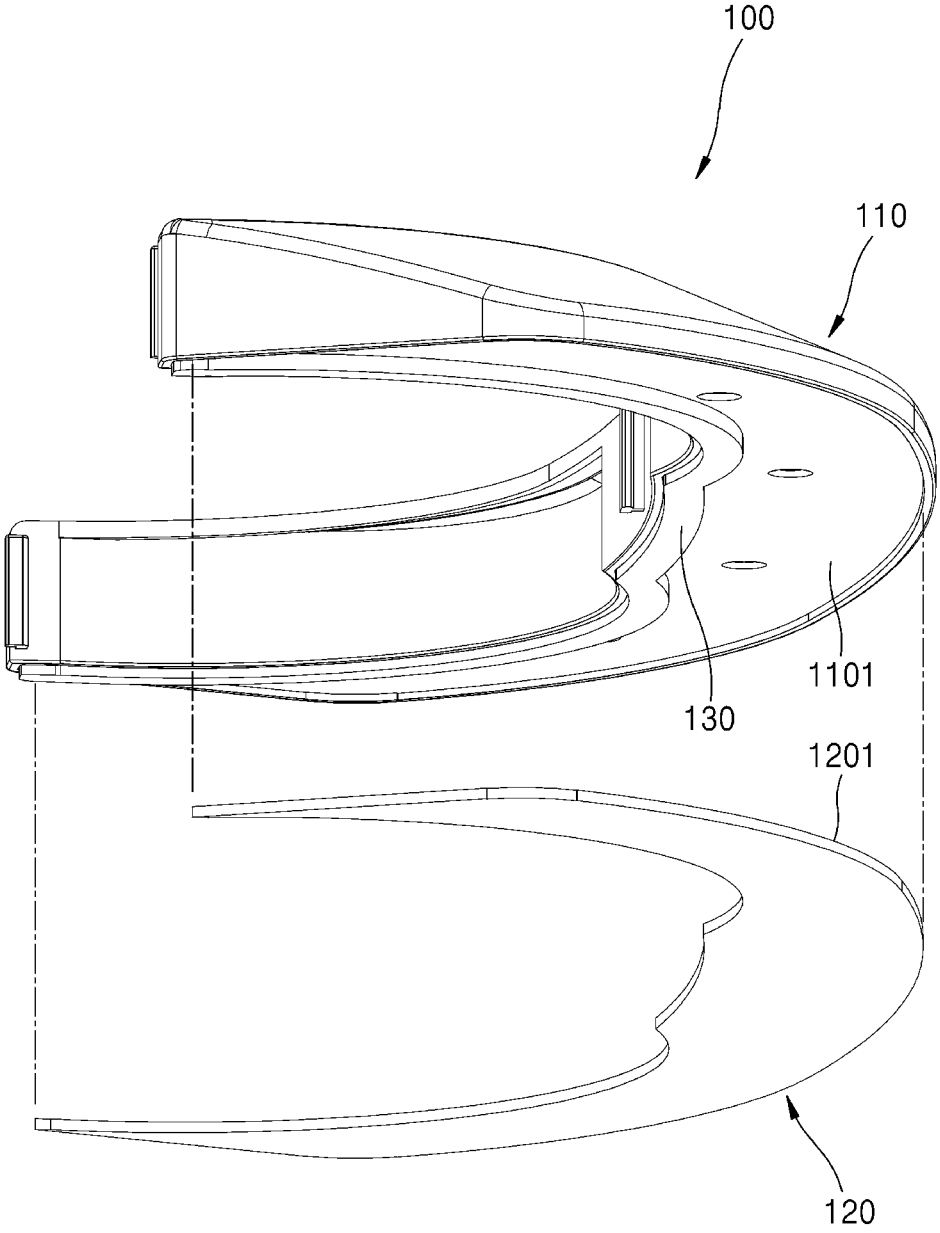
FIG. 10 is a view for describing an example of a state where an electrostatic adsorption pad is detached from a contamination prevention module, according to an embodiment of the disclosure.

FIG. 9 is a view for describing an example of a state where the electrostatic adsorption pad 120 is detached from the wet robot cleaner 1 of FIG. 5. FIG. 10 is a view for describing an example of a state where the electrostatic adsorption pad 120 is detached from the contamination prevention module 120, according to an embodiment of the disclosure.

Referring to FIGS. 5 and 9, the electrostatic adsorption pad 120 may be detachably attached to a bottom of the coupling body 110. For example, the electrostatic adsorption pad 120 may be attached to the coupling body 110 in a Velcro manner. That is, the electrostatic adsorption pad 120 and the coupling body 110 may be attached to each other by a hook&loop fastener. A bottom surface 1101 of the coupling body 110 may include a hook or a loop, and a top surface of the electrostatic adsorption pad 120 may include a loop or hook attachable to the bottom surface 1101 of the coupling body 110. Thus, a user may easily replace the electrostatic adsorption pad 120 in the coupling body 110 of the contamination prevention module 100.

When the contamination prevention module 110 is mounted on the wet robot cleaner 1, the electrostatic adsorption pad 120 may be separated from the coupling body 110. In another example, as shown in FIG. 10, when the contamination prevention module 100 is separated from the wet robot cleaner 1, the electrostatic adsorption pad 120 may be separated from the coupling body 110.

Referring back to FIGS. 5 and 6, the foreign substance barrier wall 130 may be arranged between the rotational wet pad 22 and the electrostatic adsorption pad 120 to prevent the foreign substance D adsorbed in the electrostatic adsorption pad 120 from moving to the rotational wet pad 22.

The foreign substance barrier wall 130 arranged on a bottom of the coupling body 110. While the coupling body 110 is coupled to the body 21 of the wet cleaning module 2, the electrostatic adsorption pad 120 is located in front of the rotational wet pad 2 and configured to electrostatically adsorb a foreign substance on the surface CF under the electrostatic adsorption pad 120. The foreign substance barrier 130 is arranged between the rotational wet pad 22 and the electrostatic adsorption pad 120 to prevent the foreign substance adsorbed on the electrostatic adsorption pad 120 from moving to the rotational wet pad 22.

Figure 11:
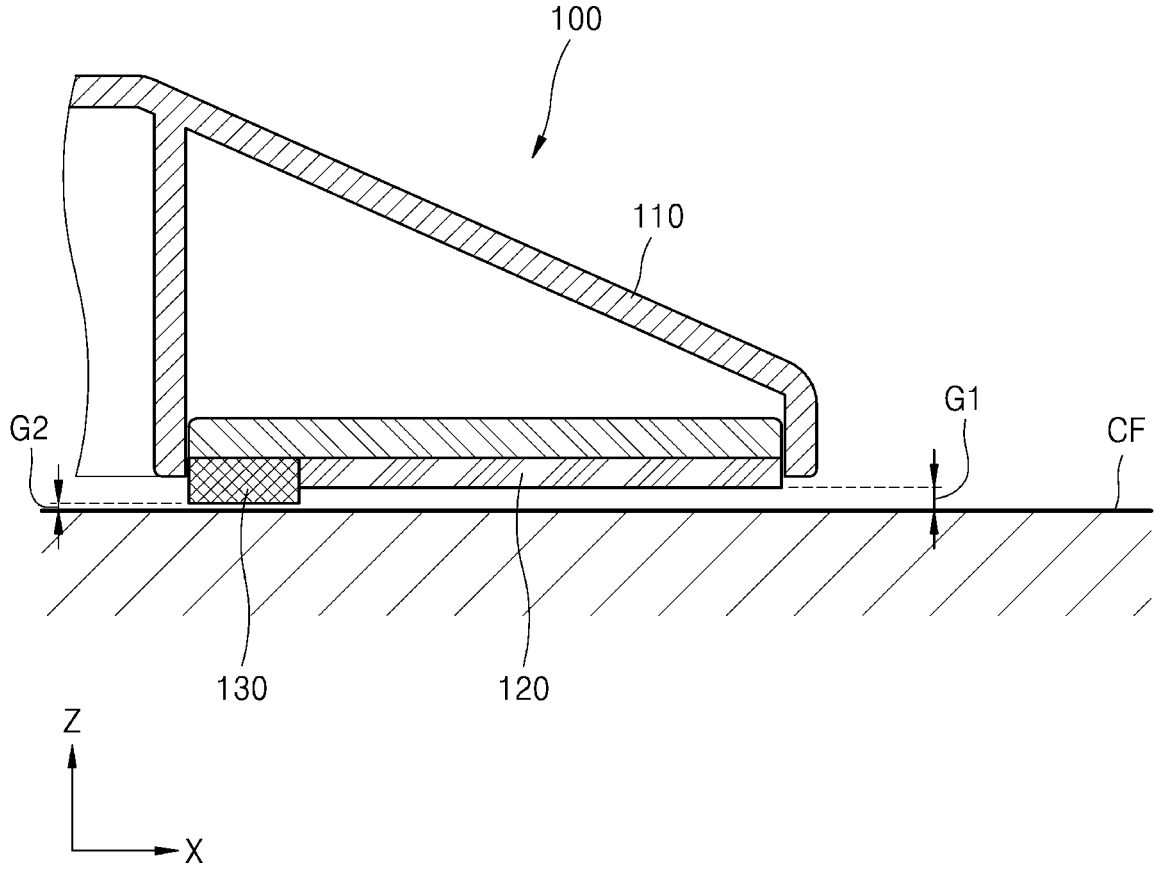
FIG. 11 is a view for describing an example of a foreign substance barrier wall of a contamination prevention module, according to an embodiment of the disclosure.
Figure 12:
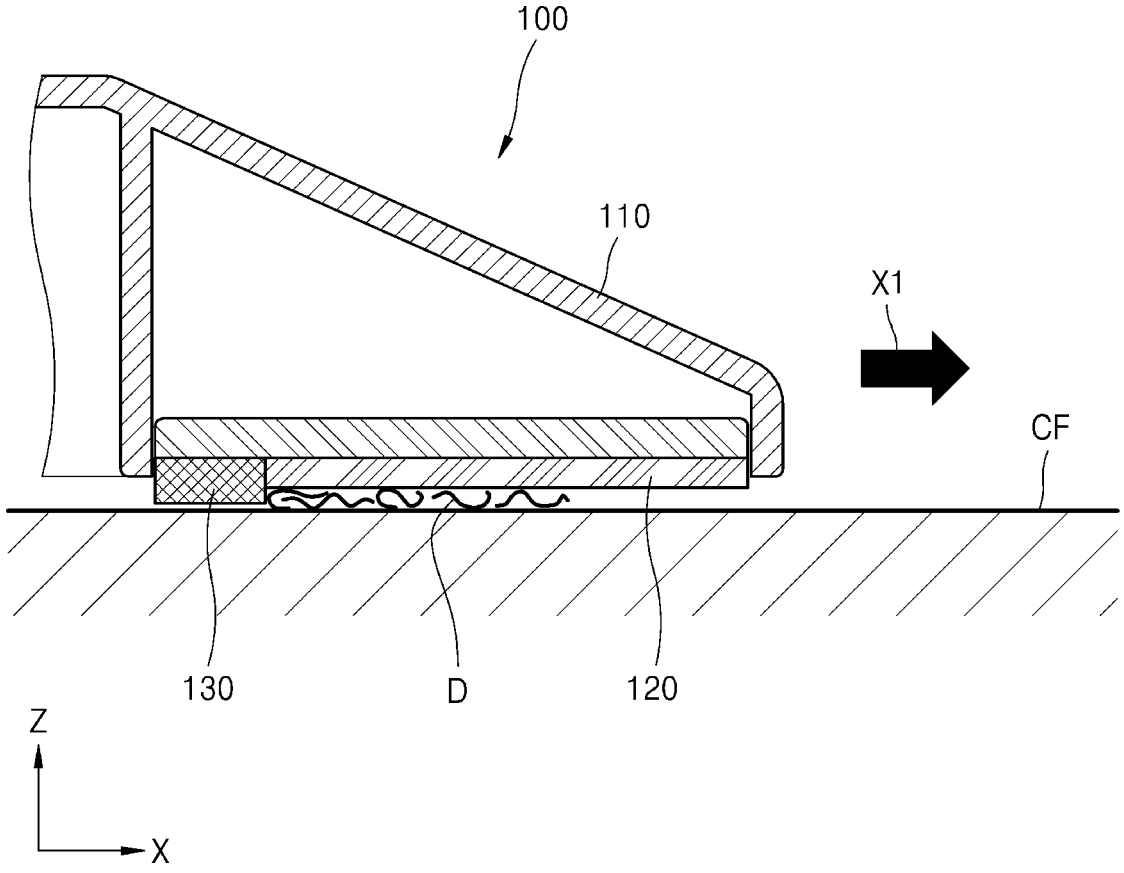
FIG. 12 is a view for describing a foreign substance barrier in the contamination prevention module of FIG. 11 according to an embodiment of the disclosure.
Figure 13:
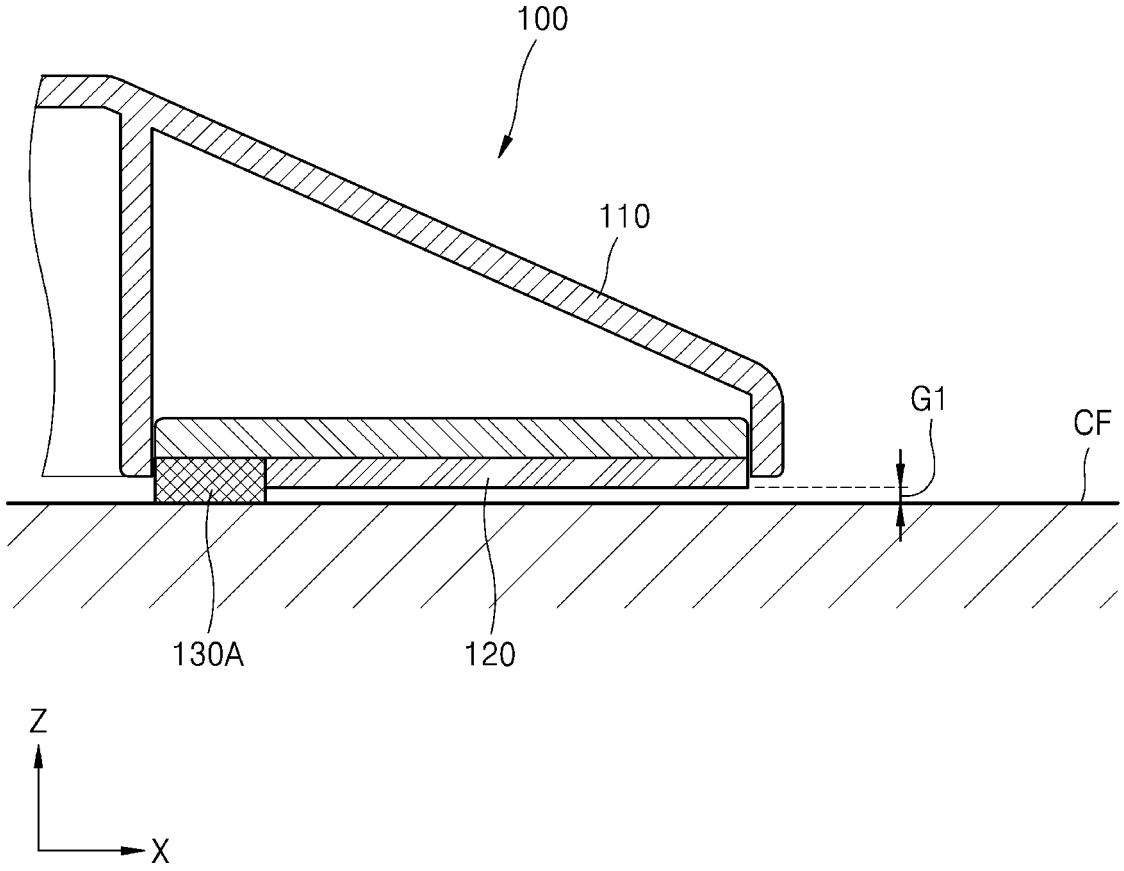
FIG. 13 is a view for describing another example of a foreign substance barrier wall of a contamination prevention module, according to an embodiment of the disclosure.

FIG. 11 is a view for describing an example of the foreign substance barrier wall 130 of the contamination prevention module 100, according to an embodiment of the disclosure, and FIG. 12 is a view for describing the foreign substance barrier wall 130 in the contamination prevention module 100 of FIG. 11. FIG. 13 is a view for describing another example of the foreign substance barrier wall 130 of the contamination prevention module 100, according to an embodiment of the disclosure.

Referring to FIG. 11, the foreign substance barrier wall 130 may be arranged closer to the surface CF than the electrostatic adsorption pad 120. The foreign substance barrier wall 130 may be arranged to protrude more than the electrostatic adsorption pad 120 toward the surface CF. For example, a gap G2 between the surface CF and the foreign substance barrier wall 130 in the up-down direction Z may be less than a gap G1 between the surface CF and the electrostatic adsorption pad 120 in the up-down direction Z.

Referring to FIGS. 11 and 12, as the wet robot cleaner 1 moves in the front direction X1, a part of the foreign substance D adsorbed in the electrostatic adsorption pad 120 may be separated from the electrostatic adsorption pad 120. The foreign substance barrier wall 130 according to an embodiment of the disclosure protrudes downward relative to the electrostatic adsorption pad 120, thereby preventing the foreign substance D from moving in the rear direction even when the part of the foreign substance D is separated from the electrostatic adsorption pad 120. Thus, the foreign substance barrier wall 130 may prevent the foreign substance D adsorbed on the electrostatic adsorption pad 120 from being delivered to the rotational wet pad 22 arranged in the rear direction.

While a description has been made of an example where the foreign substance barrier wall 130 is spaced from the surface CF, with reference to FIG. 11, the disclosure is not limited thereto as long as the example is a structure protruding toward the surface CF. For example, as shown in FIG. 13, a foreign substance barrier wall 130A may be arranged to contact the surface CF.

Figure 14:
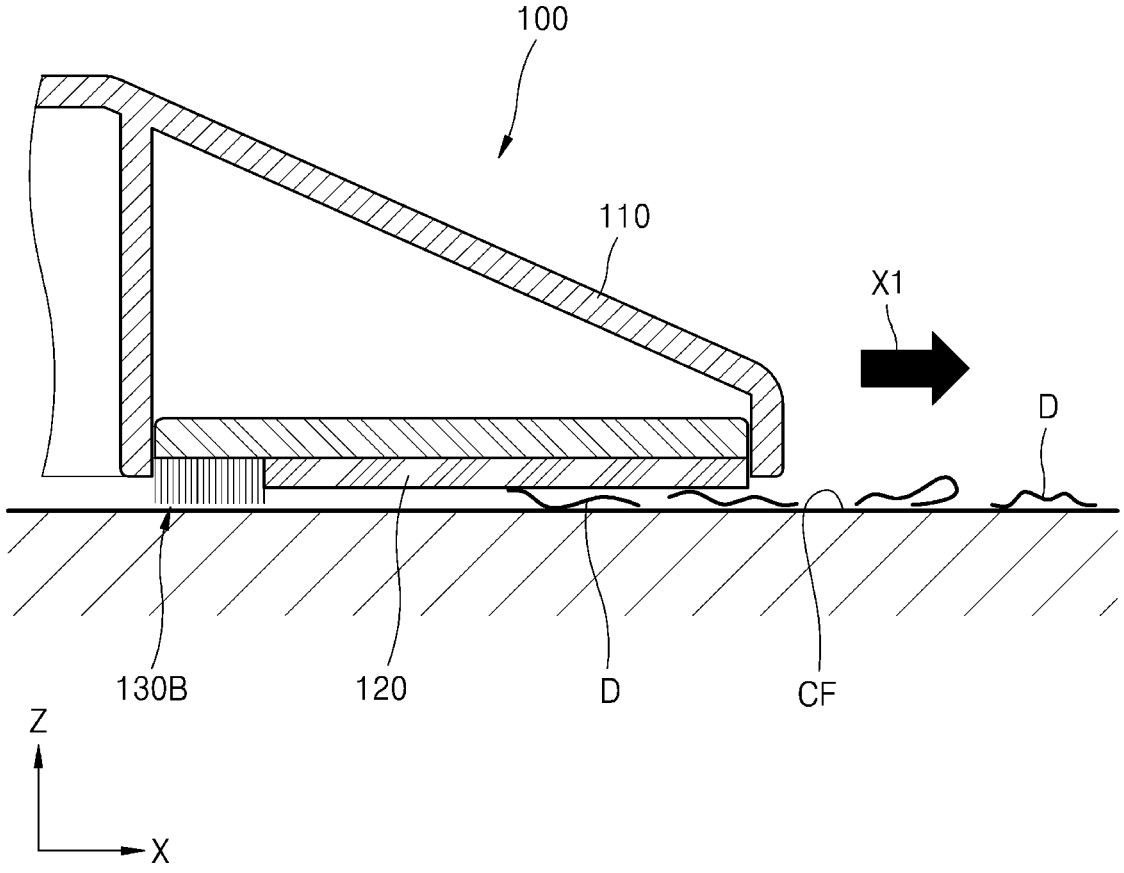
FIG. 14 is a view for describing an example of a foreign substance barrier wall according to an embodiment of the disclosure.
Figure 15:
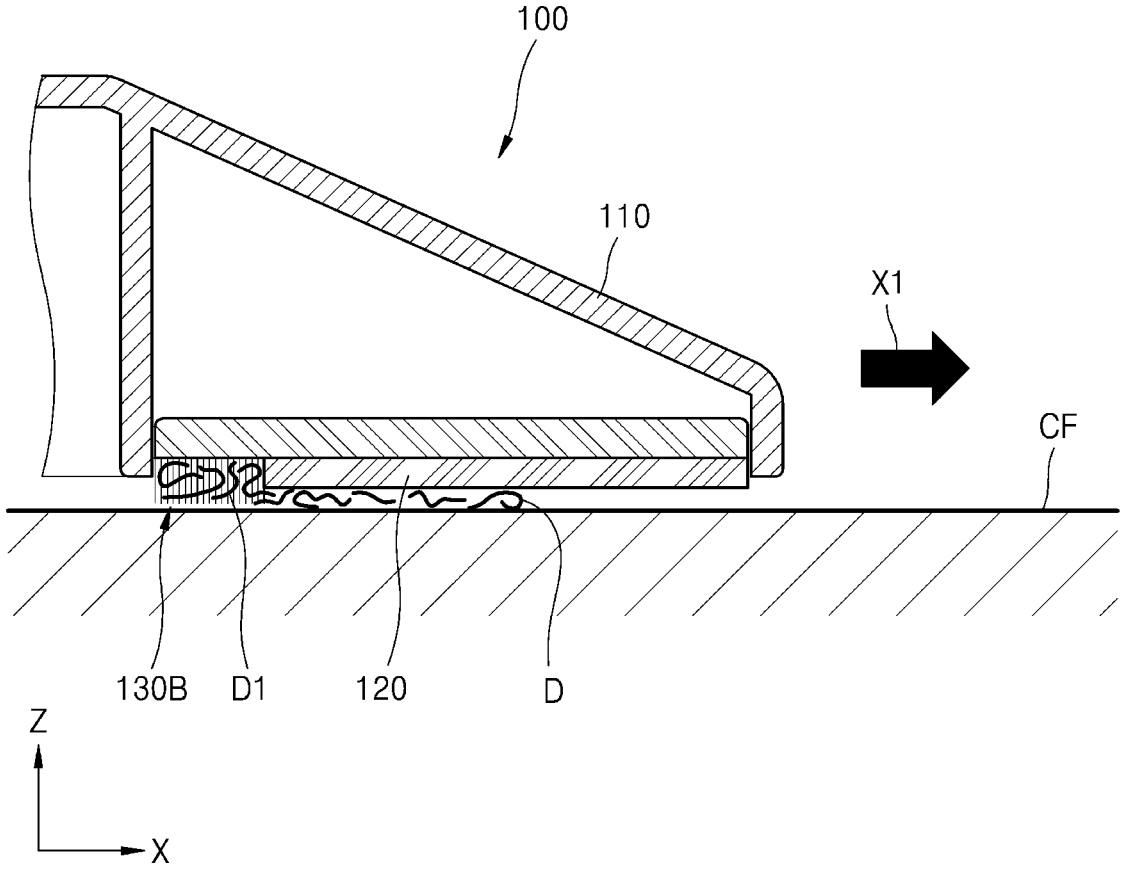
FIG. 15 is a view for describing a function of the foreign substance barrier wall of FIG. 14 according to an embodiment of the disclosure.

FIG. 14 is a view for describing an example of a foreign substance barrier wall 1306 according to an embodiment of the disclosure, and FIG. 15 is a view for describing a function of the foreign substance barrier wall 130B of FIG. 14.

Referring to FIG. 14, the foreign substance barrier wall 1306 may have a structure in which the foreign substance D is easily trapped. For example, the foreign substance barrier wall 130B may have a brush form in which the foreign substance D is trapped. For example, the foreign substance barrier wall 130B may include a plurality of thin hairs, cloth, or synthetic resin extending in the up-down direction Z. Thus, as shown in FIG. 15, even when a part D1 of the foreign substance D is separated from the electrostatic adsorption pad 120 and moves in the rear direction, the part D1 may be trapped by the foreign substance barrier wall 130B to prevent the foreign substance D from being delivered to the rotational wet pad 22.

Figure 16:
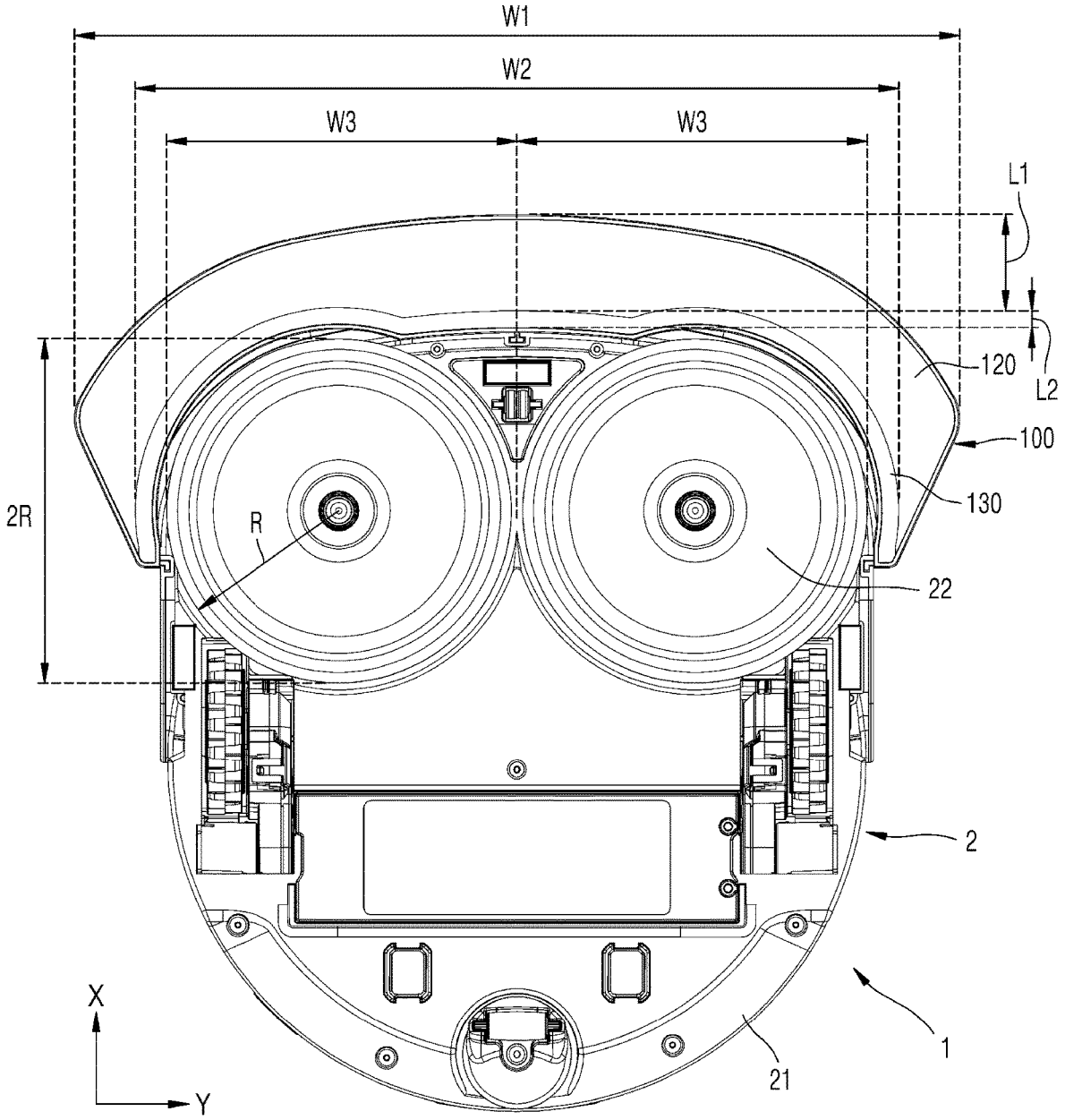
FIG. 16 is a view of a bottom of a wet robot cleaner according to an embodiment of the disclosure.

FIG. 16 is a view of the bottom of the wet robot cleaner 1 according to an embodiment of the disclosure. Referring to FIG. 16, a width of the contamination pollution module 100 in a left-right direction Y may have a size to prevent the foreign substance D from being delivered to the rotational wet pad 22 of the wet cleaning module 2.

For example, a width W1 of the electrostatic adsorption pad 120 in the left-right direction Y may be greater than a width (=W3+W3) of the rotational wet pad 22 in the left-right direction Y. For example, a width W2 of the foreign substance barrier wall 130 in the left-right direction Y may be greater than the width (=W3+W3) of the rotational wet pad 22 in the left-right direction Y. The width W2 of the foreign substance barrier wall 130 in the left-right direction Y may be less than the width W1 of the electrostatic adsorption pad 120 in the left-right direction Y.

A length L2 of the foreign substance barrier wall 130 in the front-rear direction X may have a certain length in which the foreign substance D separated from the electrostatic adsorption pad 120 may be entangled. For example, the length L2 of the foreign substance barrier wall 130 in the front-rear direction X may be equal to or greater than about 10 mm.

The length L2 of the foreign substance barrier wall 130 in the front-rear direction X may be less than the length L1 of the electrostatic adsorption pad 120 in the front-rear direction X. For example, when the length L1 of the electrostatic adsorption pad 120 in the front-rear direction X is about 3 cm to about 7 cm, the length L2 of the foreign substance barrier wall 130 in the front-rear direction X may be less than about 3 cm. The length L1 of the electrostatic adsorption pad 120 in the front-rear direction X may be less than a diameter 2R of the rotational wet pad 22. The length L1 of the electrostatic adsorption pad 120 in the front-rear direction X may be less than a radius R of the rotational wet pad 22.

Meanwhile, in the above-described embodiment of the disclosure, a description has been made of an example where a width of the contamination prevention module 100 in the left-right direction Y is greater than the width (=W3+W3) of the rotational wet pad 22, but the disclosure is not limited thereto. For example, although not shown, the width W1 of the electrostatic adsorption pad 120 in the left-right direction Y may be equal to the width (=W3+W3) of the rotational wet pad 22 in the left-right direction Y. The width W2 of the foreign substance barrier wall 130 in the left-right direction Y may be equal to the width (=W3+W3) of the rotational wet pad 22 in the left-right direction Y. The width W1 of the electrostatic adsorption pad 120 in the left-right direction Y may be equal to or greater than the width (=W3+W3) of the rotational wet pad 22 in the left-right direction Y. The width W2 of the foreign substance barrier wall 130 in the left-right direction Y may be equal to or greater than the width (=W3+W3) of the rotational wet pad 22 in the left-right direction Y.

Figure 17:
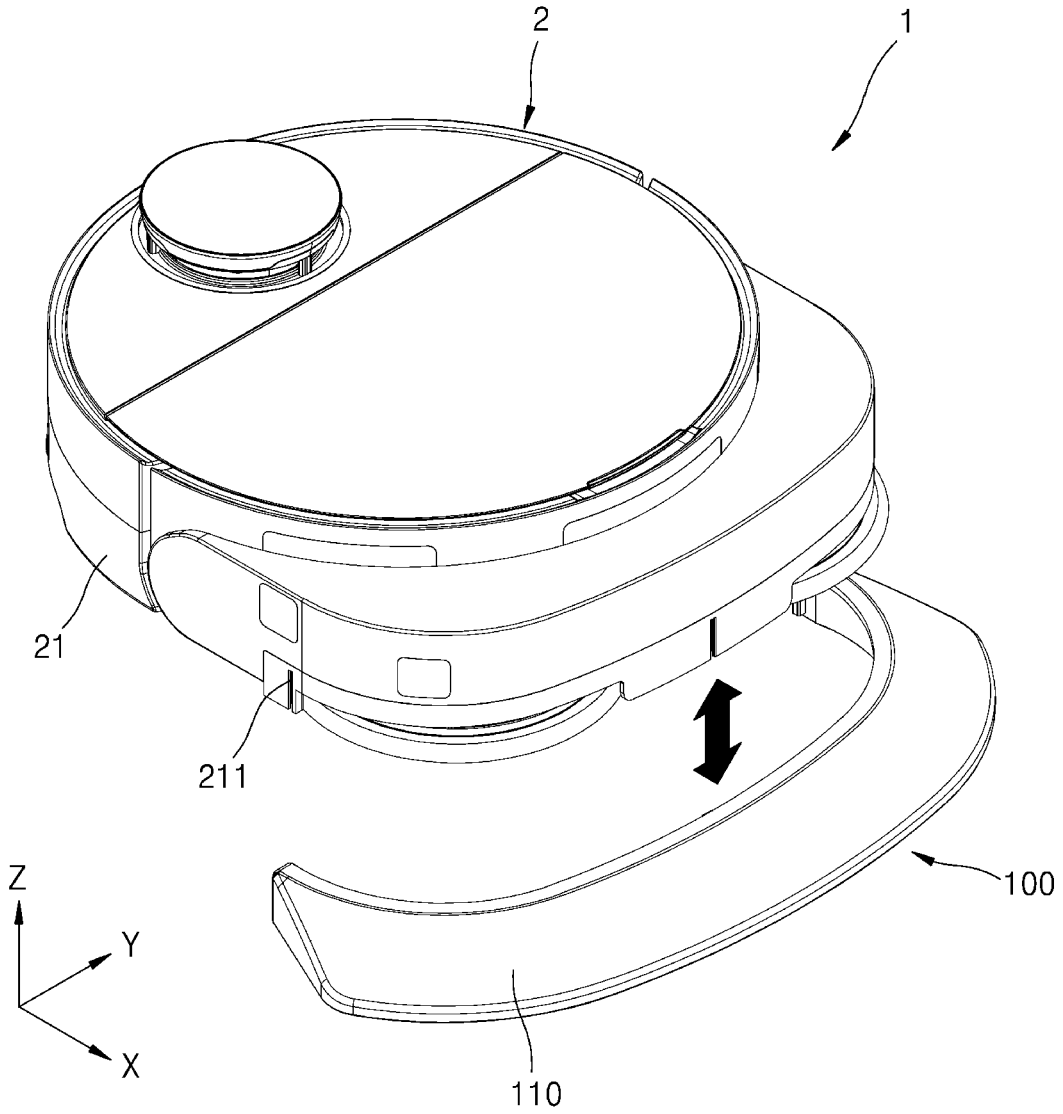
FIGS. 17 and 18 are views for describing a detachment structure and process of a contamination prevention module, according to an embodiment of the disclosure.
Figure 18:
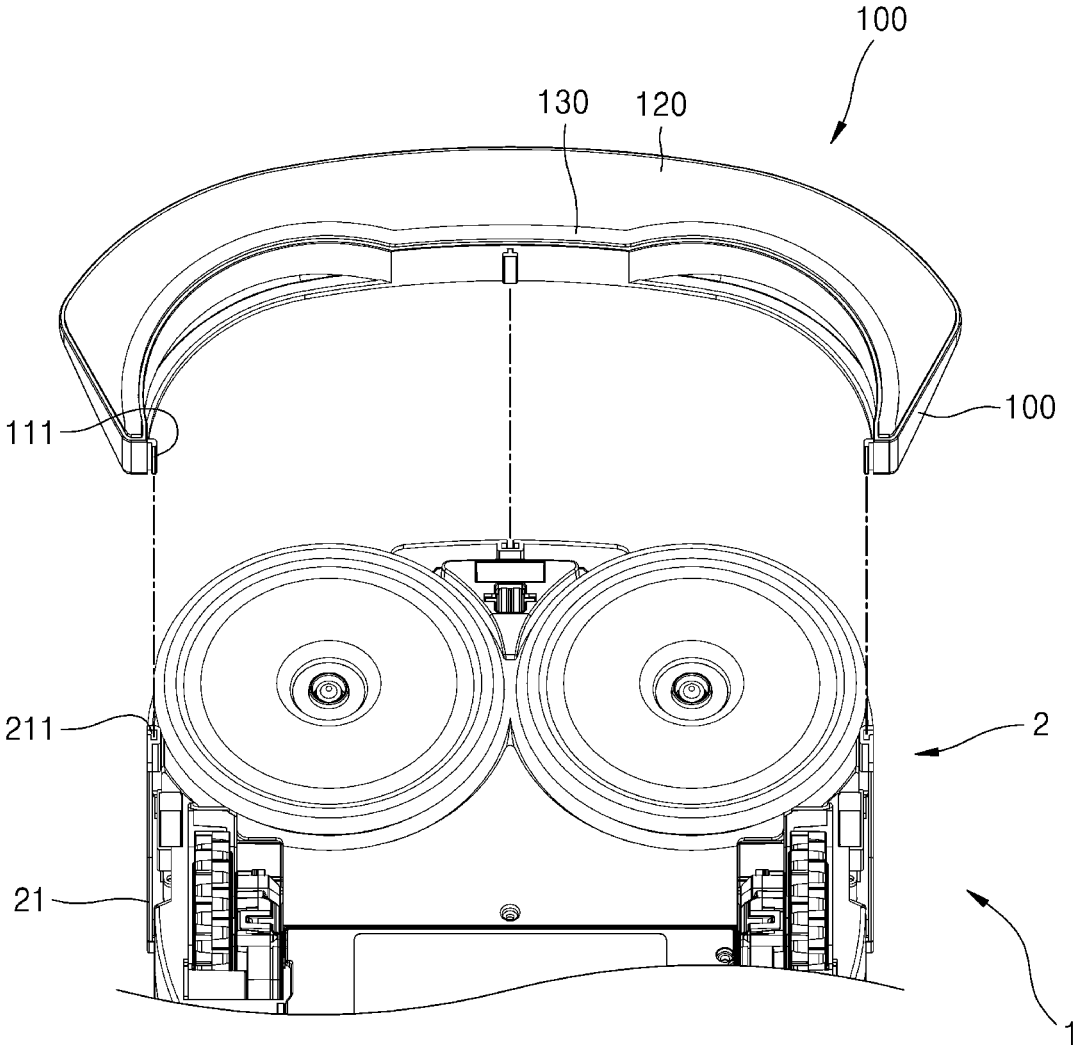

FIGS. 17 and 18 are views for describing a detachment structure and process of the contamination prevention module 100 according to an embodiment of the disclosure.

Referring to FIGS. 17 and 18, the contamination prevention module 100 according to an embodiment of the disclosure may have a structure detachable from the wet cleaning module 2. The contamination prevention module 100 operates without separate power, thus requiring no separate driving force and no electric connection structure with the wet cleaning module 2. Thus, a structure for detachment of the contamination prevention module 100 may also be simply designed.

For example, the body 21 of the wet cleaning module 2 and the coupling body 110 of the contamination prevention module 100 may have a structure allowing sliding coupling. For example, the structure allowing sliding coupling may include a guide groove 211 extending in the up-down direction Z and a guide protrusion 111 capable of sliding coupling to the guide groove 211. For example, the body 21 may include at least one guide groove 211 and the coupling body 110 may include at least one guide protrusion 111 capable of sliding coupling to the guide groove 211.

As such, through the detachable contamination prevention module 100, the user may easily replace the contamination prevention module 100. The user may selectively use the contamination prevention module 100 when necessary. As a result, the wet robot cleaner 1 may perform wet cleaning in a state of having mounted thereon the contamination prevention module 100 or may perform wet cleaning in a state of the contamination prevention module 100 being separated therefrom.

In the above-described embodiment of the disclosure, a sliding coupling structure is illustrated as the coupling structure of the body 21 and the coupling body 110, but the coupling structure of the body 21 and the coupling body 110 is not limited thereto, and various modifications may be possible.

Referring back to FIGS. 5, 7, and 8, the wet robot cleaner 1 according to an embodiment of the disclosure may move in the front direction X1. When the wet robot cleaner 1 moves in the front direction X1, the rotational wet pad 22 may move in the front direction X1 while rotating with respect to the body 21.

Various foreign substances D may exist on the surface CF located in the front side of the wet robot cleaner 1. For example, the foreign substance D such as hair, pet hair, etc., may exist on the surface CF.

The contamination prevention module 100 arranged in the front side of the rotational wet pad 22 may adsorb the foreign substance D existing on the surface CF located in the front side of the rotational wet pad 22, and prevent the adsorbed foreign substance D from being delivered to the rotational wet pad 22.

When the wet robot cleaner 1 moves in the front direction X1, the electrostatic adsorption pad 120 located in a forefront thereof may adsorb the foreign substance D in the electrostatic manner. When the wet robot cleaner 1 moves in the front direction X1, a part of the foreign substance D adsorbed on the electrostatic adsorption pad 120 by various causes such as friction with the surface CF, a moving speed of the wet robot cleaner 1, etc., may be separated from the electrostatic adsorption pad 120.

Figure 19:
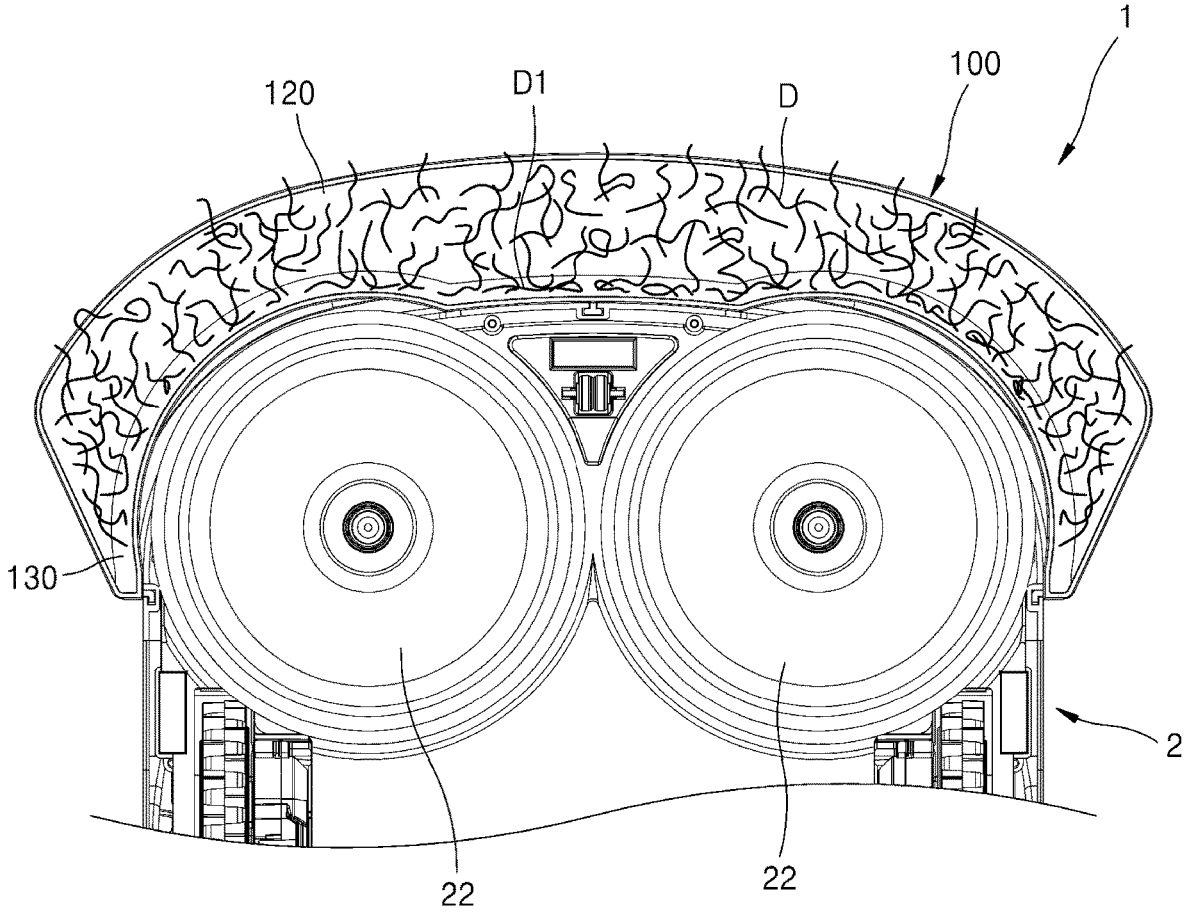
FIG. 19 is a view of a state after a wet robot cleaner including a contamination prevention module, according to an embodiment of the disclosure, operates.

FIG. 19 is a view of a state after the wet robot cleaner 1 including the contamination prevention module 100, according to an embodiment of the disclosure, operates. Referring to FIG. 19, as the wet robot cleaner 1 moves, most of the foreign substance D may be adsorbed on the electrostatic adsorption pad 120 and a partial foreign substance D1 may be separated from the electrostatic adsorption pad 120. Movement of the partial foreign substance D1 separated from the electrostatic adsorption pad 120 may be limited by the foreign substance barrier wall 130 arranged between the electrostatic adsorption pad 120 and the rotational wet pad 22. Movement of the foreign substance D1 separated from the electrostatic adsorption pad 120 in the rear direction may be limited by a height difference between the foreign substance barrier wall 130 and the electrostatic adsorption pad 120 or may be limited by being trapped in a gap of the foreign substance barrier wall 130.

As such, the wet robot cleaner 1 may prevent or reduce contamination of the rotational wet pad 22 due to the foreign substances D and D1 by the contamination prevention module 100 including the electrostatic adsorption pad 120 and the foreign substance barrier wall 130. Thus, the rotational wet pad 22 may maintain a state suitable for wet cleaning for a long time due to the foreign substance D on the surface CF.

The contamination prevention module 100 according to an embodiment of the disclosure has a structure for adsorbing and supporting the foreign substance D without a separate driving force, thereby designing the structure simply. Therefore, the size increase of the wet robot cleaner 1 may be minimized, thereby maintaining wet cleaning for a space with a narrow width or a low height. Moreover, the weight of the contamination prevention module 100 may be designed to be small, thereby minimizing battery efficiency degradation corresponding to installation of the contamination prevention module 100.

To understand the disclosure, reference numerals have been given in embodiments of the disclosure shown in the drawings, and specific terms are used to describe the embodiments of the disclosure, but the disclosure is not limited by the specific terms, and the disclosure may include all the components that are normally thought by those of ordinary skill in the art.

Certain executions described here are embodiments of the disclosure, not limiting the scope of the disclosure in any way. For the brevity of the specification, the description of conventional electronic configurations, control systems, software, and other functional aspects of the systems may be omitted. Connections of lines or connection members between components shown in the drawings are illustrative of functional connections and/or physical or circuit connections, and in practice, may be represented as alternative or additional various functional connections, physical connections, or circuit connections. In addition, when there is no specific mentioning, such as "essential" or "important", it may not be a necessary component for the application of the disclosure. An expression such as "comprising", "including", etc., used herein has been used to be understood as terms of an open end of the description.

In the specification (especially, claims) of the disclosure, the use of the term "the" and similar indicators thereof may correspond to both the singular and the plural. In addition, when the range is described in the disclosure, the range includes the disclosure to which an individual value falling within the range is applied (unless stated otherwise), and is the same as the description of an individual value constituting the range in the detailed description of the disclosure. Finally, when there is no apparent description of the order of operations constituting the method according to the disclosure or a contrary description thereof, the operations may be performed in an appropriate order. However, the disclosure is not necessarily limited according to the describing order of the operations. The use of all examples or exemplary terms (for example, etc.) in the disclosure are to simply describe the disclosure in detail, and unless the range of the disclosure is not limited by the examples or the exemplary terms unless limited by the claims. In addition, it would be apparent to those of ordinary skill in the art that various modifications and changes may be easily made without departing from the scope and spirit of the disclosure.

According to an embodiment of the present disclosure, a wet robot cleaner and a contamination prevention module used therefor are provided, making it possible to slow down contamination of a wet pad for wet cleaning by a foreign substance.

A wet cleaning robot according to an embodiment of the disclosure includes a body configured to be movable on a surface to be cleaned, a rotational wet pad arranged on a bottom of the body and including a wettable surface configured to contact the surface to wet clean the surface, an electrostatic adsorption pad arranged in front of the rotational wet pad and configured to electrostatically adsorb a foreign substance on the surface under the electrostatic adsorption pad, and a foreign substance barrier wall arranged between the rotational wet pad and the electrostatic adsorption pad to prevent the foreign substance adsorbed on the electrostatic adsorption pad from moving to the rotational wet pad.

The electrostatic adsorption pad may be configured to be separated from the surface in an up-down direction such that the foreign substance on the surface overlaps the electrostatic adsorption pad and is adsorbed on the electrostatic adsorption pad.

A width of the electrostatic adsorption pad in a left-right direction may be equal to or greater than a width of the rotational wet pad in the left-right direction.

The wet cleaning robot may further include a coupling body detachably mounted on the body, in which the electrostatic adsorption pad is arranged on a bottom of the coupling body.

The electrostatic adsorption pad may be configured to be detachably attached to the bottom of the coupling body.

The coupling body may include a structure configured to be slidably coupled to the body in an up-down direction.

A gap between the surface and the foreign substance barrier wall in an up-down direction may be less than a gap between the surface and the electrostatic adsorption pad in the up-down direction.

The foreign substance barrier wall may have a brush shape to trap the foreign substance therein.

A width of the foreign substance barrier wall in a left-right direction may be equal to or greater than a width of the rotational wet pad in the left-right direction.

A length of the foreign substance barrier wall in a front-rear direction may be less than a length of the electrostatic adsorption pad in the front-rear direction.

A pair of driving wheels may be installed in the body, and the rotational wet pad may be arranged in front of the pair of driving wheels.

In a contamination prevention module to prevent a wet cleaning module from being contaminated by a foreign substance according to an embodiment of the disclosure, the wet cleaning module includes a body movable on a surface to be cleaned and a rotational wet pad arranged on a bottom of the body, including a wettable surface to wet clean the surface, and the contamination prevention module includes a coupling body configured to be detachably coupled to the body of the wet cleaning module, an electrostatic adsorption pad arranged on a bottom of the coupling body, and a foreign substance barrier wall arranged on a bottom of the coupling body. While the coupling body is coupled to the body of the wet cleaning module, the electrostatic adsorption pad is located in front of the rotational wet pad and configured to electrostatically adsorb a foreign substance on the surface under the electrostatic adsorption pad, and the foreign substance barrier is arranged between the rotational wet pad and the electrostatic adsorption pad to prevent the foreign substance adsorbed on the electrostatic adsorption pad from moving to the rotational wet pad.

The electrostatic adsorption pad may be configured to be separated from the surface in an up-down direction such that the foreign substance on the cleaning surface overlaps the electrostatic adsorption pad and is adsorbed on the electrostatic adsorption pad.

A width of the electrostatic adsorption pad in a left-right direction may be equal to or greater than a width of the rotational wet pad in the left-right direction.

The electrostatic adsorption pad may be configured to be detachably attached to the bottom of the coupling body.

The coupling body may include a structure configured to be slidably coupled to the body in an up-down direction.

A gap between the surface and the foreign substance barrier wall in an up-down direction may be less than a gap between the surface and the electrostatic adsorption pad in the up-down direction.

The foreign substance barrier wall may have a brush shape to trap the foreign substance therein.

A width of the foreign substance barrier wall in a left-right direction may be equal to or greater than a width of the rotational wet pad in the left-right direction.

A length of the foreign substance barrier wall in a front-rear direction may be less than a length of the rotational wet pad in the front-rear direction.

The wet cleaning robot and the contamination prevention module used therefor according to the above-described embodiments of the disclosure may adsorb the foreign substance in the front direction of the rotational wet pad to prevent or reduce adsorption of the foreign substance in the rotational wet pad, thereby improving a wet cleaning capability.

The invention claimed is:

1. A wet cleaning robot comprising:

a body configured to be movable on a surface to be cleaned;

a rotational wet pad arranged on a bottom of the body and including a wettable surface configured to contact the surface to wet clean the surface;

an electrostatic adsorption pad arranged in front of the rotational wet pad and configured to electrostatically adsorb a foreign substance on the surface under the electrostatic adsorption pad; and a foreign substance barrier wall arranged between the rotational wet pad and the electrostatic adsorption pad to prevent the foreign substance adsorbed on the electrostatic adsorption pad from moving to the rotational wet pad.

2. The wet cleaning robot of claim 1, wherein the electrostatic adsorption pad is configured to be separated from the surface in an up-down direction such that the foreign substance on the surface overlaps the electrostatic adsorption pad and is adsorbed on the electrostatic adsorption pad.

3. The wet cleaning robot of claim 1, wherein a width of the electrostatic adsorption pad in a left-right direction is equal to or greater than a width of the rotational wet pad in the left-right direction.

4. The wet cleaning robot of claim 1, further comprising:

a coupling body detachably mounted on the body, wherein the electrostatic adsorption pad is arranged on a bottom of the coupling body.

5. The wet cleaning robot of claim 4, wherein the electrostatic adsorption pad is configured to be detachably attached to the bottom of the coupling body.

6. The wet cleaning robot of claim 4, wherein the coupling body includes a structure configured to be slidably coupled to the body in an up-down direction.

7. The wet cleaning robot of claim 1, wherein a gap between the surface and the foreign substance barrier wall in an up-down direction is less than a gap between the surface and the electrostatic adsorption pad in the up-down direction.

8. The wet cleaning robot of claim 1, wherein the foreign substance barrier wall has a brush shape to trap the foreign substance therein.

9. The wet cleaning robot of claim 1, wherein a width of the foreign substance barrier wall in a left-right direction is equal to or greater than a width of the rotational wet pad in the left-right direction.

10. The wet cleaning robot of claim 1, wherein a length of the foreign substance barrier wall in a front-rear direction is less than a length of the electrostatic adsorption pad in the front-rear direction.

11. The wet cleaning robot of claim 1, wherein a pair of driving wheels are installed in the body, and the rotational wet pad is arranged in front of the pair of driving wheels.

12. A contamination prevention module to prevent a wet cleaning module from being contaminated by a foreign substance, the wet cleaning module including a body that is movable on a surface to be cleaned and a rotational wet pad on a bottom of the body with a wettable surface to wet clean the surface, and the contamination prevention module comprising:

a coupling body configured to be detachably coupled to the body of the wet cleaning module;

an electrostatic adsorption pad arranged on a bottom of the coupling body; and a foreign substance barrier wall arranged on a bottom of the coupling body, wherein, the contamination prevention module is configured so that, while the coupling body is coupled to the body of the wet cleaning module:

the electrostatic adsorption pad is located in front of the rotational wet pad and configured to electrostatically adsorb a foreign substance on the surface under the electrostatic adsorption pad, and the foreign substance barrier is arranged between the rotational wet pad and the electrostatic adsorption pad to prevent the foreign substance adsorbed on the electrostatic adsorption pad from moving to the rotational wet pad.

13. The contamination prevention module of claim 12, wherein the electrostatic adsorption pad is configured to be separated from the surface in an up-down direction such that the foreign substance on the cleaning surface overlaps the electrostatic adsorption pad and is adsorbed on the electrostatic adsorption pad.

14. The contamination prevention module of claim 12, wherein a width of the electrostatic adsorption pad in a left-right direction is equal to or greater than a width of the rotational wet pad in the left-right direction.

15. The contamination prevention module of claim 12, wherein the electrostatic adsorption pad is configured to be detachably attached to the bottom of the coupling body.

16. The contamination prevention module of claim 12, wherein the coupling body includes a structure configured to be slidably coupled to the body in an up-down direction.

17. The contamination prevention module of claim 12, wherein a gap between the surface and the foreign substance barrier wall in an up-down direction is less than a gap between the surface and the electrostatic adsorption pad in the up-down direction.

18. The contamination prevention module of claim 12, wherein the foreign substance barrier wall has a brush shape to trap the foreign substance therein.

19. The contamination prevention module of claim 12, wherein a width of the foreign substance barrier wall in a left-right direction is equal to or greater than a width of the rotational wet pad in the left-right direction.

20. The contamination prevention module of claim 12, wherein a length of the foreign substance barrier wall in a front-rear direction is less than a length of the rotational wet pad in the front-rear direction.

* * * * *